US008893592B2

(12) United States Patent
Womack

(10) Patent No.: US 8,893,592 B2
(45) Date of Patent: Nov. 25, 2014

(54) ADJUSTABLE SOCKET

(71) Applicant: Brett Womack, San Francisco, CA (US)

(72) Inventor: Brett Womack, San Francisco, CA (US)

( * ) Notice: Subject to any disclaimer, the term of this patent is extended or adjusted under 35 U.S.C. 154(b) by 221 days.

(21) Appl. No.: 13/706,736

(22) Filed: Dec. 6, 2012

(65) Prior Publication Data

US 2014/0053693 A1 Feb. 27, 2014

Related U.S. Application Data

(60) Provisional application No. 61/692,996, filed on Aug. 24, 2012.

(51) Int. Cl.

| | |
|---|---|
| ***B25B 13/12*** | (2006.01) |
| ***B25B 13/18*** | (2006.01) |
| ***B25B 13/20*** | (2006.01) |
| ***B25B 13/06*** | (2006.01) |

(52) U.S. Cl.

CPC ..... *B25B 13/12* (2013.01); *B25B 13/18* (2013.01); *B25B 13/20* (2013.01); *B25B 13/06* (2013.01)

USPC ..... 81/128

(58) Field of Classification Search

CPC ..... B25B 13/12; B25B 13/18; B25B 13/20

USPC ..... 81/128, 129, 90.2, 90.3

See application file for complete search history.

(56) References Cited

U.S. PATENT DOCUMENTS

| | | | | |
|---|---|---|---|---|
| 877,773 | A | 1/1908 | Holm | |
| 1,503,635 | A | 8/1924 | Butler | |
| 2,580,247 | A * | 12/1951 | Secondi et al. | 81/53.2 |
| 2,742,297 | A | 4/1956 | Bilz | |
| 2,778,260 | A | 1/1957 | Jovanovich | |
| 2,884,826 | A | 5/1959 | Bruhn | |
| 3,209,624 | A | 10/1965 | Shiftman | |
| 3,664,213 | A | 5/1972 | Anati | |
| 3,724,299 | A | 4/1973 | Nelson | |
| 4,378,714 | A | 4/1983 | Colvin | |
| 4,663,999 | A | 5/1987 | Colvin | |
| 5,207,129 | A | 5/1993 | Fossella | |
| 5,337,634 | A | 8/1994 | Carnesi | |
| 5,740,704 | A | 4/1998 | Payne | |
| 5,768,961 | A | 6/1998 | Frawley | |
| 5,791,209 | A | 8/1998 | Marks | |
| 5,819,607 | A | 10/1998 | Carnesi | |
| 5,918,511 | A | 7/1999 | Sabbaghian et al. | |
| 5,996,446 | A | 12/1999 | Lee | |
| 6,073,522 | A | 6/2000 | Carnesi | |
| 6,889,579 | B1 | 5/2005 | Brown | |
| 6,971,284 | B2 | 12/2005 | Owoc | |
| 7,062,996 | B2 | 6/2006 | Johnson | |
| 7,261,021 | B1 | 8/2007 | Carnesi | |
| 7,290,467 | B2 | 11/2007 | Harker | |
| 7,707,916 | B2 | 5/2010 | Pirseyedi | |
| 7,946,200 | B2 * | 5/2011 | Chang | 81/128 |
| 7,992,470 | B2 | 8/2011 | Brown | |

* cited by examiner

*Primary Examiner* — David B Thomas

(57) ABSTRACT

An adjustable socket including a housing designed on a longitudinal axis, with a series of grooves extending longitudinally along the interior wall. A disc with guide slots intruding obliquely off-center from the perimeter is locked into position within the housing. Jaw members with bottom stems and cams are mounted in the disc guide slots, free to move laterally along fixed paths. An axially rotatable drive core with a cam surface is positioned within the housing, engaging the cam of each jaw. Rotation of the drive core forces the jaws to travel inwardly along the disc guide slots as dictated by the spiraling guide elements of the cam surface, to be forced against a fastener within the jaws. A locking mechanism holds the jaws in position on the fastener. Release of the locking mechanism allows rotation of the drive core in the opposite direction to release the fastener.

20 Claims, 22 Drawing Sheets

ADJUSTABLE SOCKET

RELATED APPLICATION

This application is a utility patent application based on U.S. provisional patent application No. 61692996, filed on Aug. 24, 2012, entitled "Adjustable Socket", which is incorporated herein by reference and made a part of this application.

BACKGROUND OF THE INVENTION

An adjustable socket that can fit varying sizes of fasteners (nuts, bolts, etc.) can replace several fixed-size sockets, reducing the components of a socket set into a minimal number of tools. An adjustable socket allows for streamlining of workflow, as time is no longer spent finding and selecting the correct fixed-size socket from a set. An adjustable socket may also more tightly grip a damaged or worn fastener than a fixed-size socket.

Several adjustable sockets exist in the prior art which are manually adjustable to fit varying sizes of fasteners, by means of a plurality of jaws which are moveable along a fixed path. However, despite the basic functionality of these devices, they are susceptible to inherent design restrictions that limit their effectiveness and range of operation.

The operating range of an adjustable socket with jaws whose pathways travel in a direct radial path toward the fastener is inherently limited. To allow for direct radial contraction of jaws on the head of a fastener, these devices must either have a limited number of jaws, or jaws much narrower than the faces they are intended to grip. These conditions result in less shared surface area between the sockets and fasteners, which results in reduced force potential and increased slippage.

BRIEF SUMMARY OF THE INVENTION

An adjustable socket with jaws that travel along paths oblique to the center of the socket can overcome the limitations presented by adjustable sockets with radially-moveable jaws. These oblique pathways can be longer than a corresponding radial pathway, thereby increasing the operable range of the socket. Jaws that travel along oblique pathways may slide past one another rather than contract together, allowing for a jaw of maximum possible width. This in turn creates more shared surface area between socket and fastener, increasing force potential and reducing slippage. Furthermore, jaws that slide past one another provide additional resistance against undesired rotation or tilting of the jaws by buttressing one another at the points of greatest pressure.

A well-designed adjustable socket is a simple, convenient, cost-effective alternative to a socket set, allowing for a wide range of adjustable sizes, providing the ability to apply and maintain significant force to a fastener without slipping or failing, while maintaining a sleek, aesthetic design. These qualities are included in the embodiments of the adjustable socket described below.

BRIEF DESCRIPTION OF THE SEVERAL VIEWS OF THE DRAWING

The preferred embodiments of the adjustable socket are illustrated by the following figures of the drawings. These figures and the illustrated embodiments therein are intended to be exemplary and not restrictive.

DETAILED DESCRIPTION OF THE INVENTION

Figure 1:
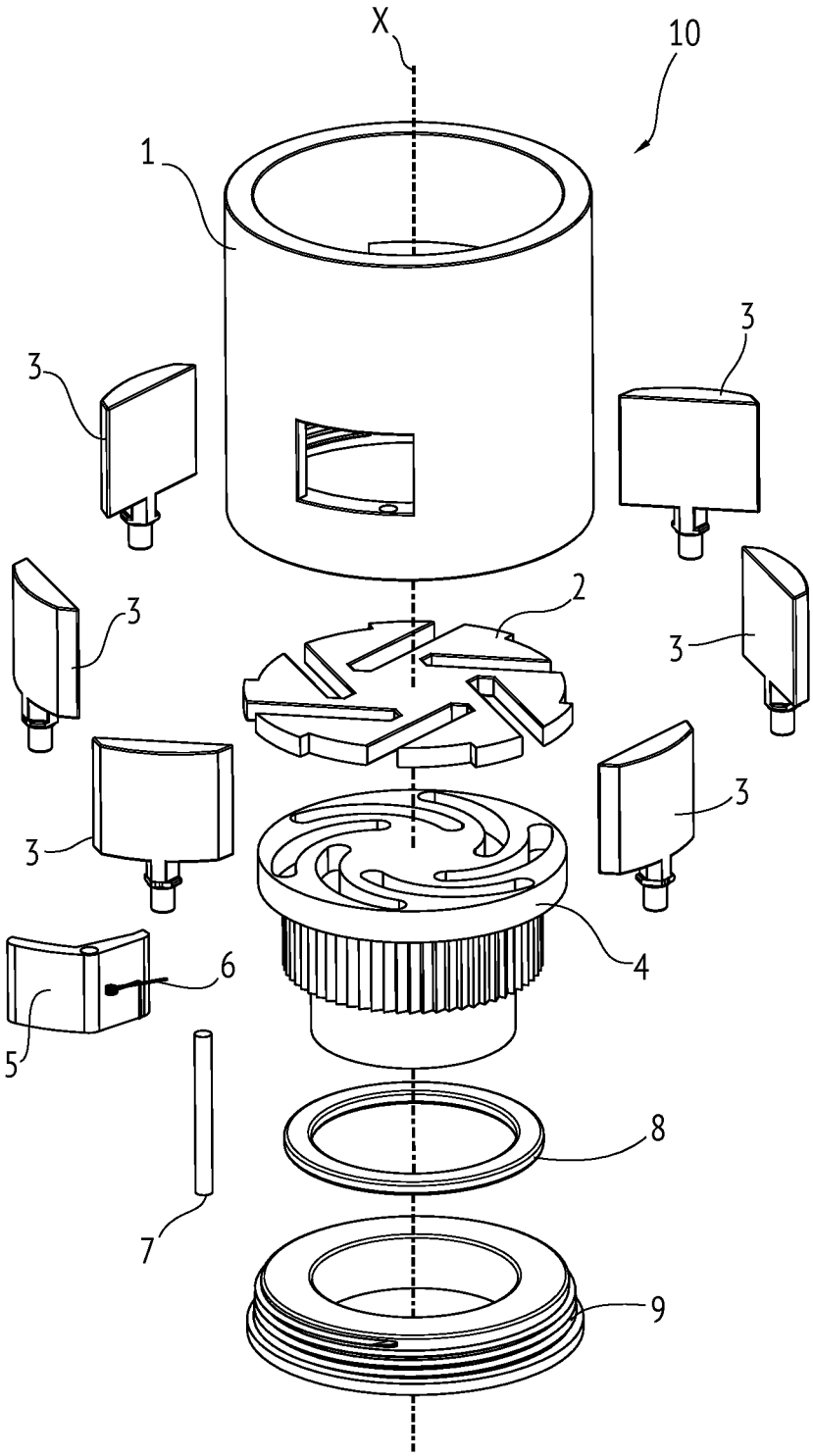
FIG. 1 is an exploded oblique view of an adjustable socket.

The following description contains concise, exact details to provide any person skilled in the art a clear and thorough understanding of the instrument described herein. Well-known elements may not be described in detail, however, to avoid unnecessary complication of the description and associated illustrations. Furthermore, the described embodiments and associated illustrations are intended to be exemplary and not restrictive, as modifications or refinements to the preferred embodiments may occur.

FIGS. 1 and 2A-2D depict an adjustable socket 10 comprising a housing 1, a disc 2, a plurality of jaws 3, a drive core 4, a locking lever 5 with biasing torsion spring 6 and pin 7, a washer 8, and a threaded plug 9.

Figure 3A:
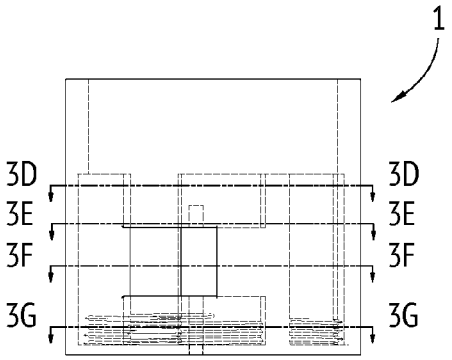
FIGS. 3A, 3B, and 3C are respectively front transparent elevation, oblique top front, and oblique bottom front views of the FIG. 1 adjustable socket's housing.
Figure 3D:
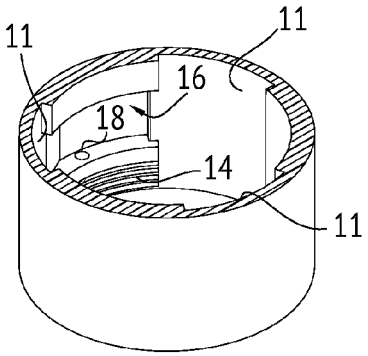
FIGS. 3D, 3E, 3F, and 3G are cross-sectional oblique top front views taken with respect to lines 3D-3D, 3E-3E, 3F-3F, and 3G-3G respectively shown in FIG. 3A.
Figure 3B:
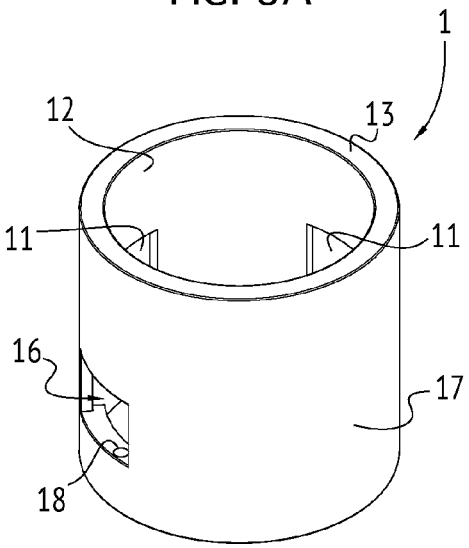
Figure 3E:
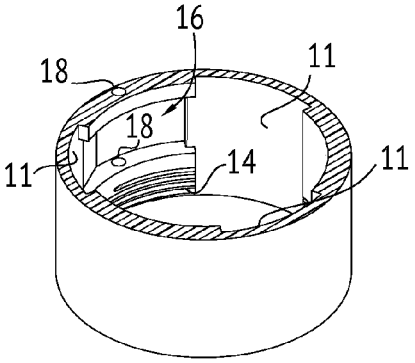
Figure 3F:
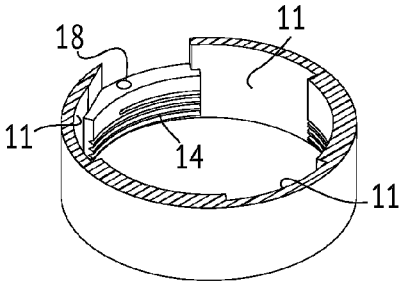
Figure 3C:
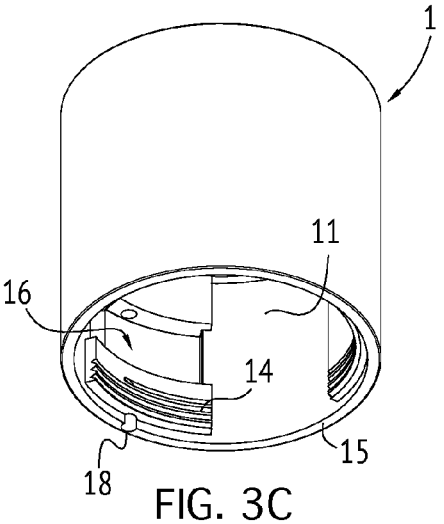
Figure 3G:
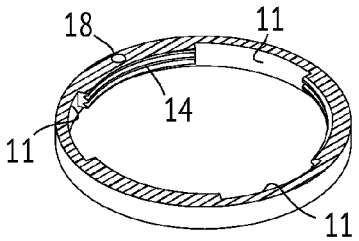
Figure 4B:
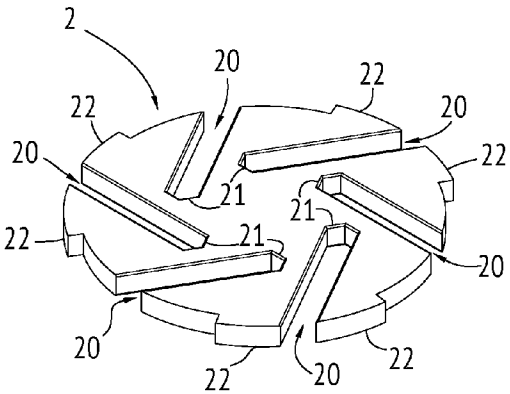
FIGS. 4A, 4B, 4C, and 4D are respectively front elevation, top plan, oblique top front, and oblique bottom front views of the FIG. 1 adjustable socket's disc.
Figure 4D:
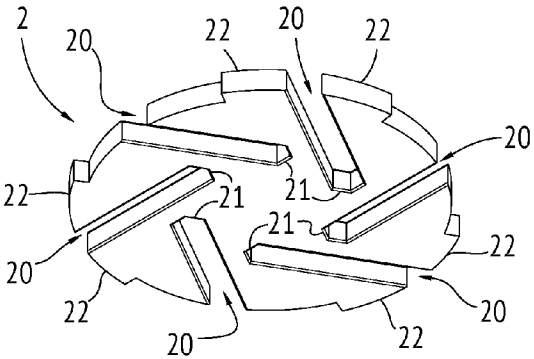
Figure 4A:
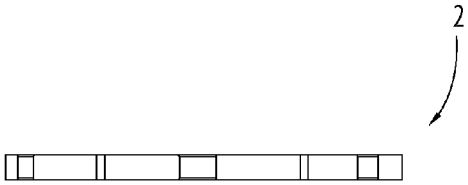
Figure 4C:
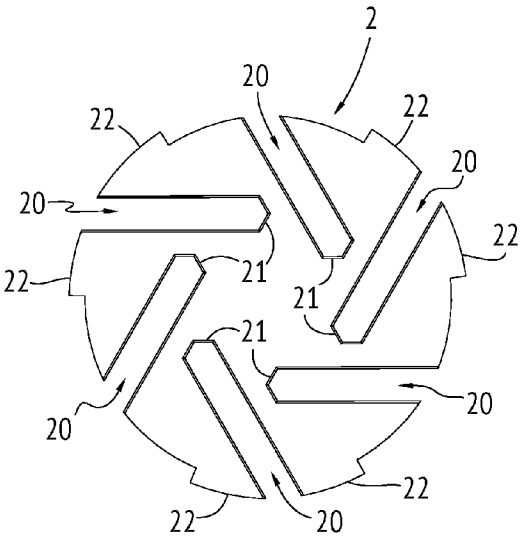
Figure 5A:
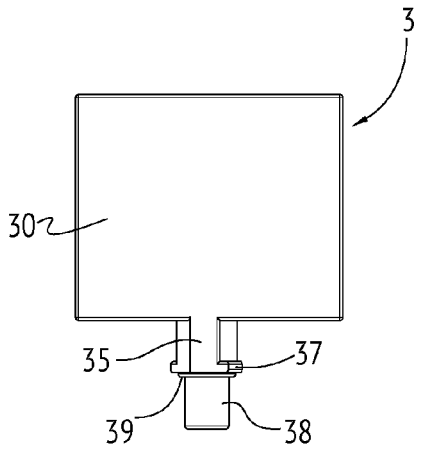
FIGS. 5A, 5B, 5C, 5D, and 5E are respectively front elevation, bottom plan, oblique top front, oblique bottom front, and oblique bottom rear views of one of the FIG. 1 adjustable socket's jaws.
Figure 5B:
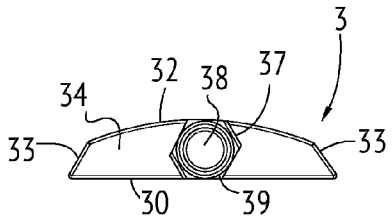
Figure 5C:
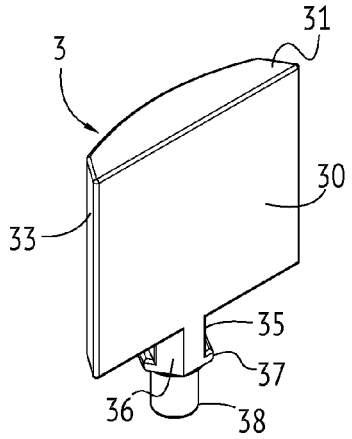
Figure 5D:
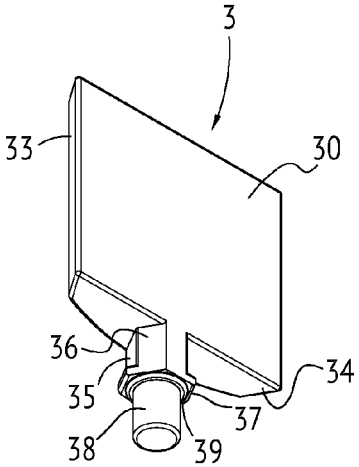
Figure 5E:
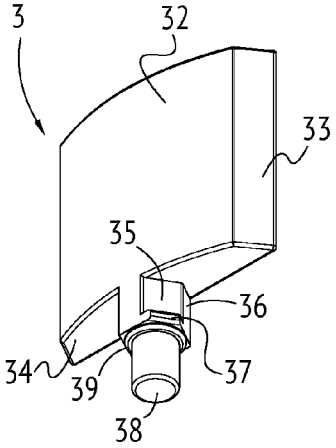

Housing 1 (also shown separately in FIGS. 3A-3C) is generally circular in cross-section, and possesses a generally cylindrical shape aligned along a longitudinal axis X. Three locking grooves 11, sized and shaped to couple with disc 2, extend longitudinally along an interior housing wall 12, terminating at a distance from a top housing lip 13. Female threads 14 are installed in the interior housing wall 12, extending from a bottom housing lip 15 and sized and shaped to couple with male threads 90 of the threaded plug 9. An aperture 16 in an exterior housing wall 17 is adapted to accept a locking lever 5 and torsion spring 6. A pin hole 18 extends from the bottom housing lip 15 through the aperture 16, adapted to couple with pin 7. Pin 7 holds the lever 5 and spring 6 assembly within the aperture, while allowing for swiveling motion of the locking assembly.

Disc 2 (also shown separately in FIGS. 4A-4D) is generally circular in cross-section with a series of six oblique guide slots 20, open to the perimeter and angled at approximately a 60 degree differential from the adjacent guide slots, each terminating with a tapered face 21. Locking tabs 22 extend out radially from the perimeter of disc 2, to allow for coupling with housing 1.

Each jaw 3 (one of which is shown separately in FIGS. 5A-5E) has a flat inward face 30, a flat top face 31, a convex outward face 32, two flat side faces 33, and a flat bottom face 34. For the purpose of this description, "inward" means facing toward axis X, and "outward" means facing away from axis X as shown in FIG. 1. Extending downward from flat bottom face 34 is a stem 35, with two beveled faces 36. Two locking tabs 37 extend laterally from the base of stem 35. A cam 38 extends downward below stem 35, with a chamfered bumper 39 along the interface between cam 38 and grooved stem 35.

Stem 35 is sized and shaped to fit snugly within the slots 20 of disc 2, and to prevent rotation of jaw 3 within slot 20 relative to axis X. Locking tabs 37 and bottom face 34 are sized and shaped to prevent vertical motion or tilting of jaw 3 within slot 20 relative to axis X. The aforementioned motion restrictions allow jaw 3 to move laterally through slot 20 from a position where convex outward face 34 rests against interior housing wall 12, to a position where beveled face 36 meets tapered face 21, and any position in between, while not tilting or rotating relative to axis X.

Figure 6A:
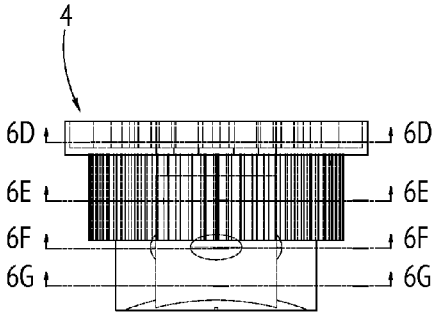
FIGS. 6A, 6B, and 6C are respectively front elevation, oblique top front, and oblique bottom front views of the FIG. 1 adjustable socket's drive core.
Figure 6D:
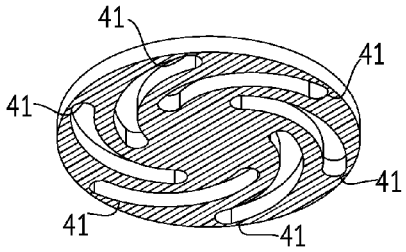
FIGS. 6D, 6E, 6F, and 6G are cross-sectional oblique bottom front views taken with respect to lines 6D-6D, 6E-6E, 6F-6F, and 6G-6G respectively shown in FIG. 6A.
Figure 6B:
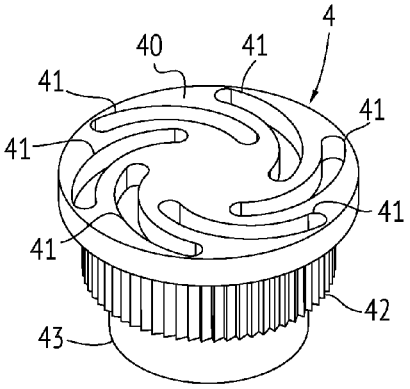
Figure 6E:
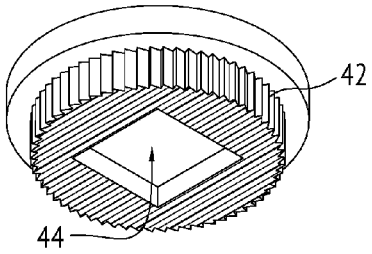
Figure 6F:
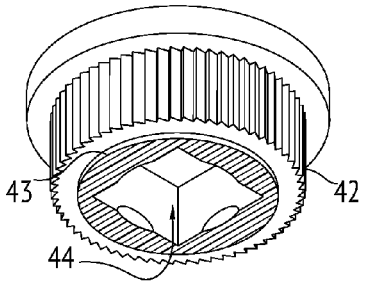

Drive core 4 (also shown separately in FIGS. 6A-6C) is generally circular in cross-section with a top cam surface 40 at a right angle to axis X, comprising six spiraling slotted guide elements 41 each sized and shaped to accept a cam 38 of jaw 3. Extending downward from cam surface 40 is a series of teeth 42 sized and shaped to be couple with locking lever 5. Extending downward from teeth 42 is a generally cylindrical drive shaft 43, within the bottom of which is drive aperture 44, sized and shaped to accept a ratcheting socket-driving tool 71 with ½ inch drive element 72 (shown in FIGS. 11A-11E).

Figure 2B:
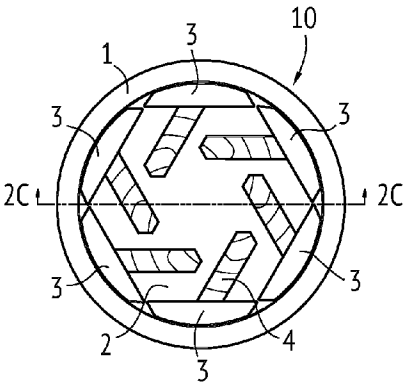
FIG. 2B is a top view of the FIG. 1 adjustable socket.
Figure 2D:
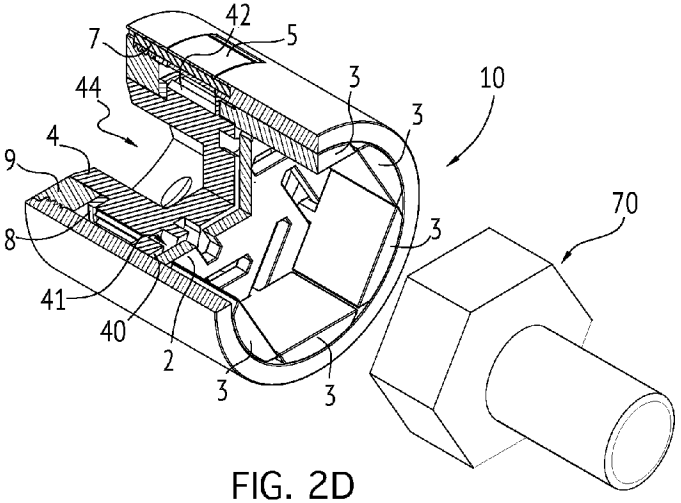
FIG. 2D is a quarter-sectional oblique top side view of the FIG. 1 adjustable socket, with a fastener shown schematically.
Figure 2A:
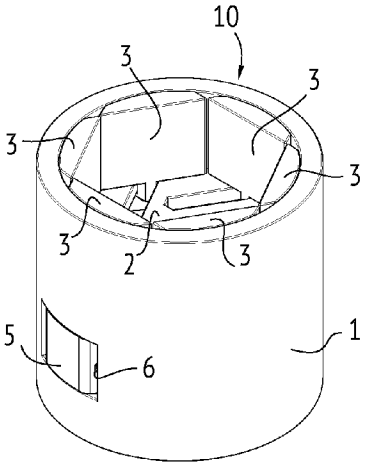
FIG. 2A is an oblique top front view of the FIG. 1 adjustable socket.
Figure 2C:
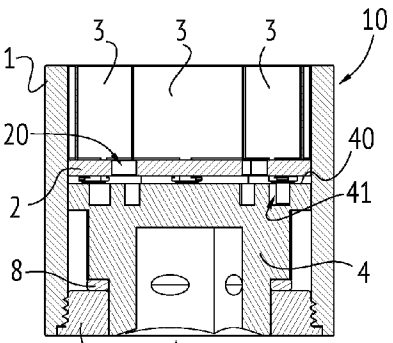
FIG. 2C is a cross-sectional view taken with respect to line 2C-2C shown in FIG. 2B.

FIGS. 7A-7D illustrate the partial assembly of adjustable socket 10, comprising disc 2, six jaws 3, and drive core 4. Inserting one jaw 3 into each slot 20 of disc 2 results in three pairs of diametrically-opposed jaws 3, which create in their center a hexagonal shape to allow for acceptance of a standard hexagonal fastener 70 as depicted in FIG. 2D. Drive core 4 is coupled with jaws 3, so that each cam 38 is inserted into a separate guide element 41 of cam surface 40.

It is understood that for the purposes of clearly illustrating the drive action of the partial assembly depicted in FIGS. 7A-7D that housing 1 is not depicted, but that its presence would hold disc 2 in the fixed position shown. It is also understood that the partial assembly depicted in FIGS. 7A-7D would be held together by the coupling of housing 1 to threaded plug 9, which is also not depicted for the sake of clarity.

As drive core 4 is rotated in the direction shown by arrow 80 (FIG. 7A), the guide elements 41 of cam surface 40 engage the cams 38 of jaws 3, contracting them into the center of drive core 4 toward axis X (shown in FIG. 1). The jaws 3 are forced to travel along the path prescribed by disc slots 20, due to being locked into the pathway by stem 35, locking tabs 37, and bottom face 34, which prevent vertical motion or tilting of jaw 3 within slot 20 relative to axis X. The angles of side faces 33 are sized and shaped to allow jaws 3 to slide past one another during operation of the mechanism without touching or dragging, while holding interior faces 38 in fixed position to one another and parallel to the corresponding faces of a fastener within jaws 3. Bumpers 39 allow for minimal mating surface area between jaws 3 and drive core 4, reducing friction and allowing for ease of motion. A jaw 3 may travel inwardly along slot 20 until beveled face 36 meets tapered face 21, at which point the smallest possible hexagonal shape is achieved.

FIGS. 8A-8D are top semi-transparent views of the FIG. 1 adjustable socket's drive mechanism, corresponding to the positions of the drive mechanism as depicted in FIGS. 7A-7D, illustrating the combined motions of jaws 3 in relation to slots 20 of disc 2 and guide elements 41 of drive core 4. It is understood that for the purposes of clearly illustrating the drive action of the partial assembly depicted in FIGS. 8A-8D that housing 1 is not depicted, but that its presence would hold disc 2 in the fixed position shown. It is also understood that the partial assembly depicted in FIGS. 8A-8D would be held together by the mating of housing 1 to threaded plug 9, which is also not depicted for the sake of clarity.

As drive core 4 is rotated in the direction shown by arrow 80 (FIG. 8A), the guide elements 41 of cam surface 40 engage the cams 38 of jaws 3, contracting them into the center of drive core 4 toward axis X (shown in FIG. 1). The jaws 3 are forced to travel along the paths prescribed by disc slots 20, indicated in FIG. 8A by arrows 81. Guide element 41A is indicated in FIGS. 8A-8D in order to illustrate the movement of drive core 4 as it is rotated in the direction indicated by arrow 80.

Figure 9B:
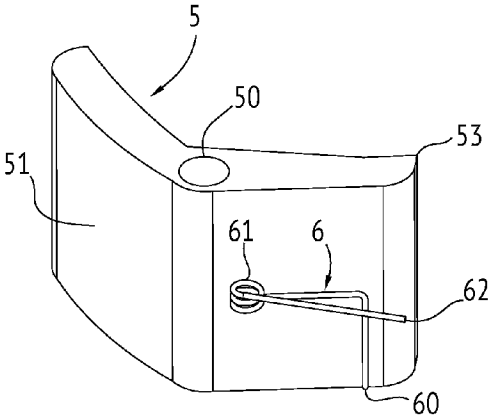
FIGS. 9A, 9B, and 9C, are respectively top plan, oblique top front, and oblique top side views of the FIG. 1 adjustable socket's locking lever and torsion spring assembly.
Figure 9D:
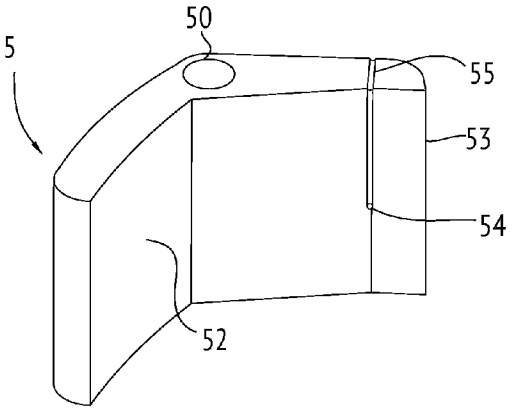
FIG. 9D is an oblique bottom rear view of the locking lever.
Figure 9A:
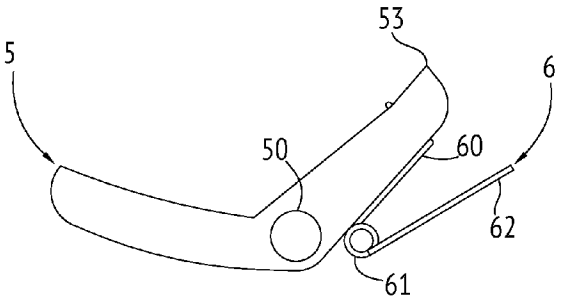
Figure 9C:
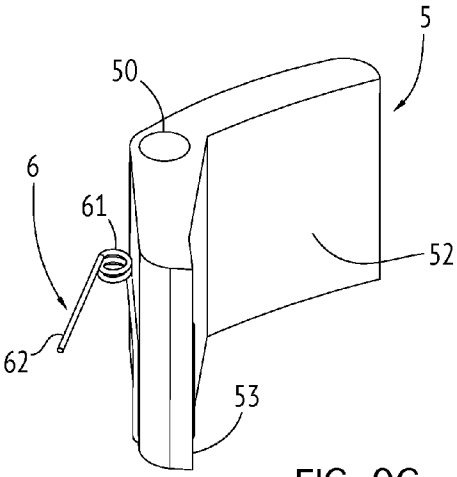
Figure 10A:
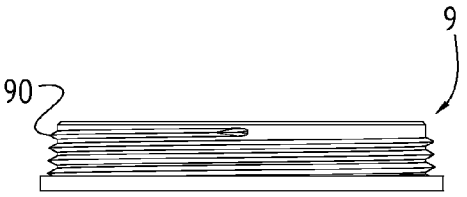
FIGS. 10A, 10B, 10C, and 10D are respectively front elevation, bottom plan, oblique top front, and oblique bottom front views of the FIG. 1 adjustable socket's threaded plug.
Figure 10B:
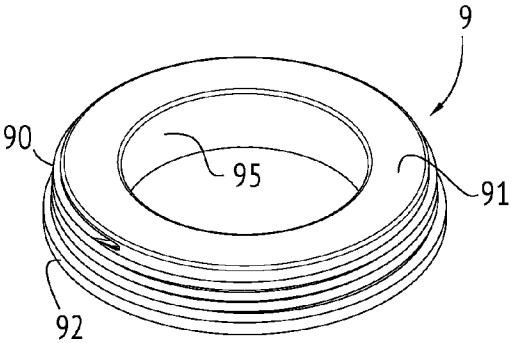
Figure 10C:
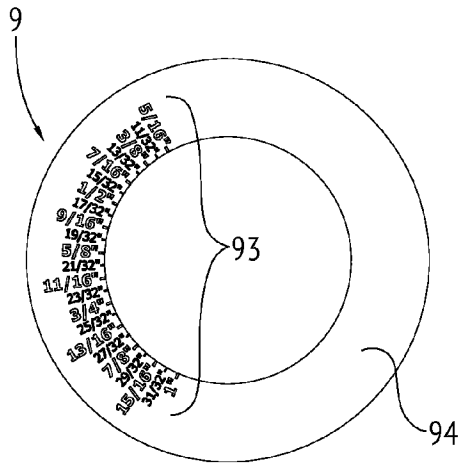
Figure 10D:
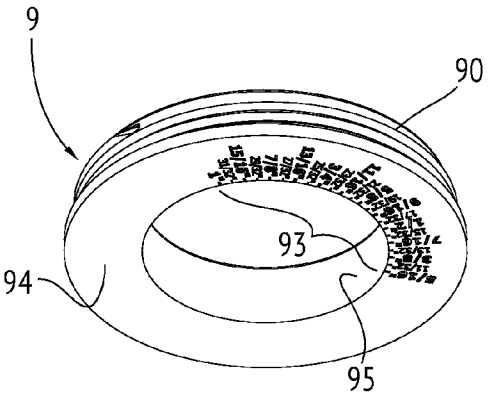

A locking mechanism comprising lever 5 and torsion spring 6 is shown in FIGS. 9A-9C. Lever 5 comprises a pin hole 50 sized and shaped to accept pin 7 (shown in FIG. 1), in order to lock in place within aperture 16 (best shown in FIG. 3B). An exterior face 51 is sized and shaped to meet flush with the exterior housing wall 17 (best shown in FIG. 2B). An interior face 52 terminates with a tooth 53, which is sized and shaped to couple with the female elements of teeth 42 of drive core 4 (best shown in FIGS. 6A-6C). A spring hole 54 and spring groove 55 (FIG. 9D) are located at the interface between the interior face 52 and tooth 53, which accept and hold a locking arm 60 of torsion spring 6. Torsion spring 6 consists of locking arm 60 that is inserted into the spring hole 54 of lever 5, a torsion element 61 that biases the spring in an open position, and a biasing arm 62 sized and shaped to meet flush against the housing interior wall 12 and bias the tooth 53 into the female elements of teeth 42 of drive core 4.

Figure 6C:
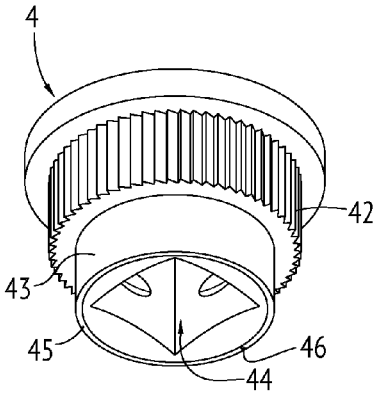
Figure 6G:
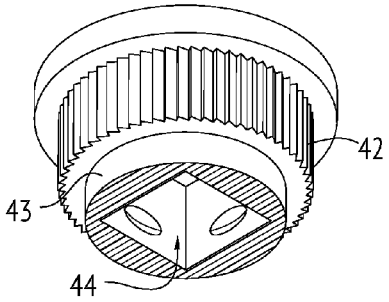
Figure 7B:
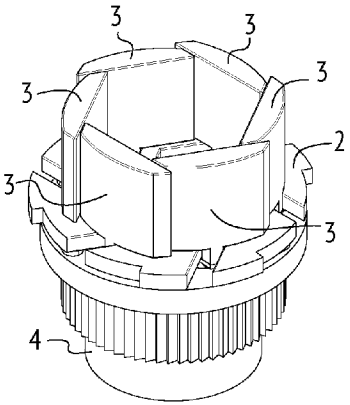
FIGS. 7B, 7C, and 7D are oblique top front views of the FIG. 1 adjustable socket's drive mechanism, illustrating the varying positions of the tightening jaws as the drive core is rotated.
Figure 7D:
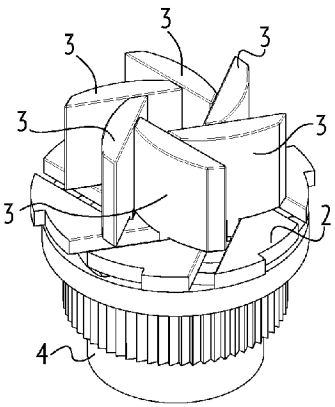
Figure 7A:
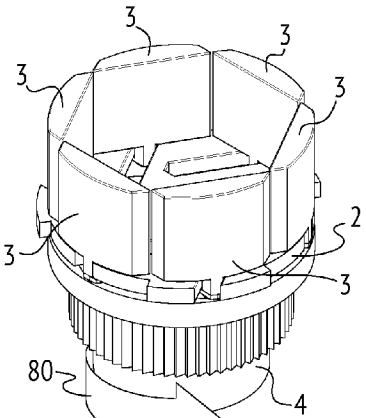
FIG. 7A is an oblique top front view of the FIG. 1 adjustable socket's drive mechanism with jaws fully opened, and an arrow depicting the motion of the drive core.
Figure 7C:
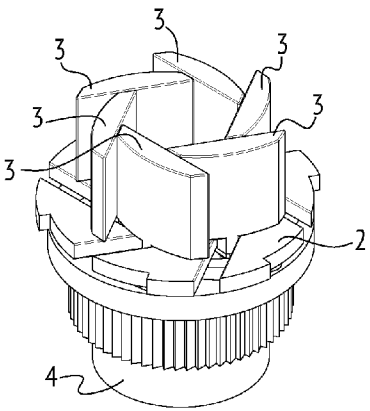
Figure 8A:
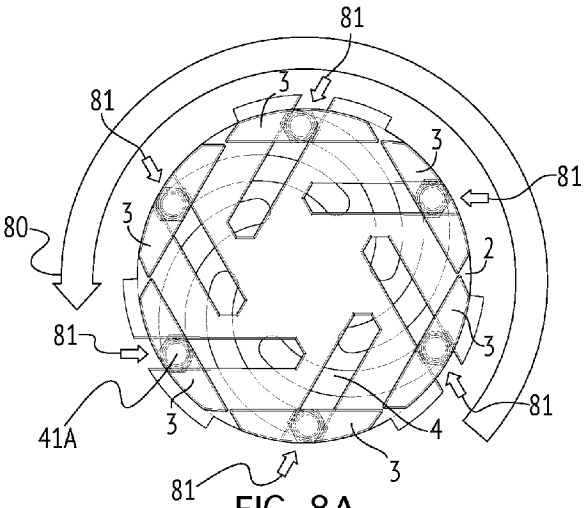
FIG. 8A is a top semi-transparent view of the FIG. 1 adjustable socket's drive mechanism with jaws fully opened, with an arrow depicting the motion of the drive core and arrows depicting the motion of the jaws.
Figure 8B:
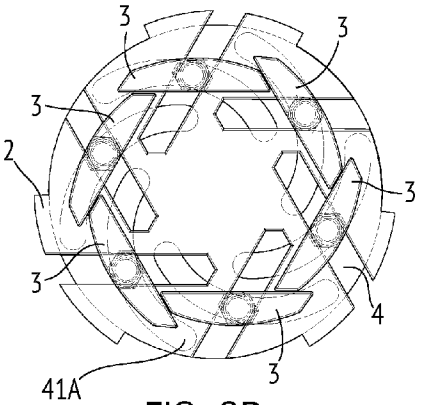
FIGS. 8B, 8C, and 8D are top transparent views of the FIG. 1 adjustable socket's drive mechanism, illustrating the varying positions of the drive core cam surface and tightening jaws as the drive core is rotated.
Figure 8C:
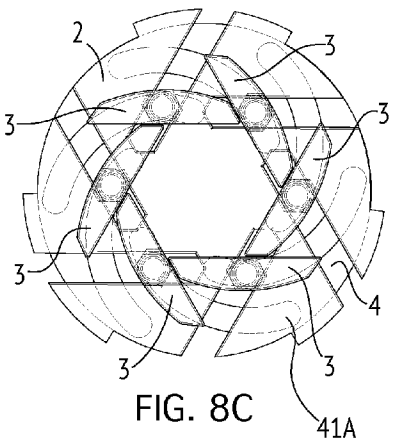
Figure 8D:
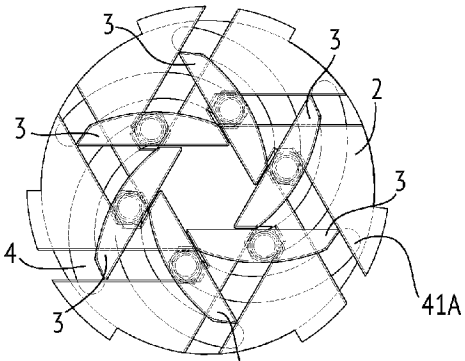

Threaded plug 9 (FIGS. 10A-10D) is generally cylindrical in shape, with a series of male threads 90 extending between a top face 91 and outer lip 92, sized and shaped to couple with the female threads 14 of housing 1. A series of sizing indicators 93 are etched into a bottom face 94, skirting the edge of an interior face 95. When threaded plug 9 is completely threaded into housing 1, outer lip 92 is sized to enter into housing 1 so that bottom face 94 couples flush with bottom housing lip 15 and a lower drive core lip 45 (FIG. 6C). Washer 8 (FIG. 1) provides slip movement between the fixed position of threaded plug 9 and drive core 4, which is provided freedom of rotation on axis X within housing 1 (best shown in FIG. 2C). As drive core 4 is rotated in direction 80, a sizing notch 46 (FIG. 6C) moves along sizing indicators 93, indicating the size of fastener that jaws 3 are currently in position to accept. This process is best illustrated by FIGS. 12D, 13D, 14D, and 15D.

Figure 11A:
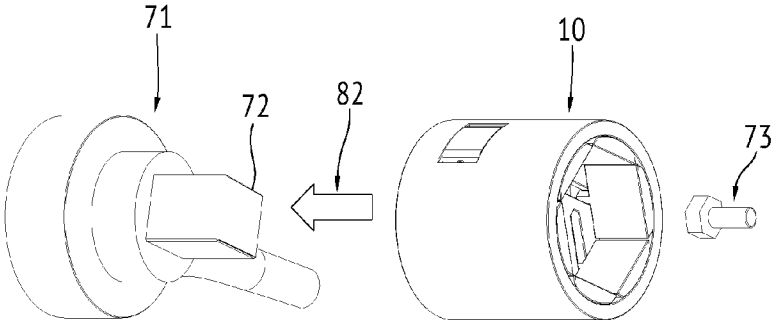
FIGS. 11A and 11B are respectively oblique side exploded and oblique side views showing the FIG. 1 adjustable socket coupling with a half-inch ratcheting socket-driving tool.
Figure 11B:
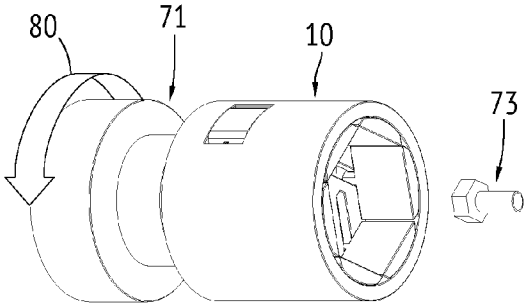
Figure 11C:
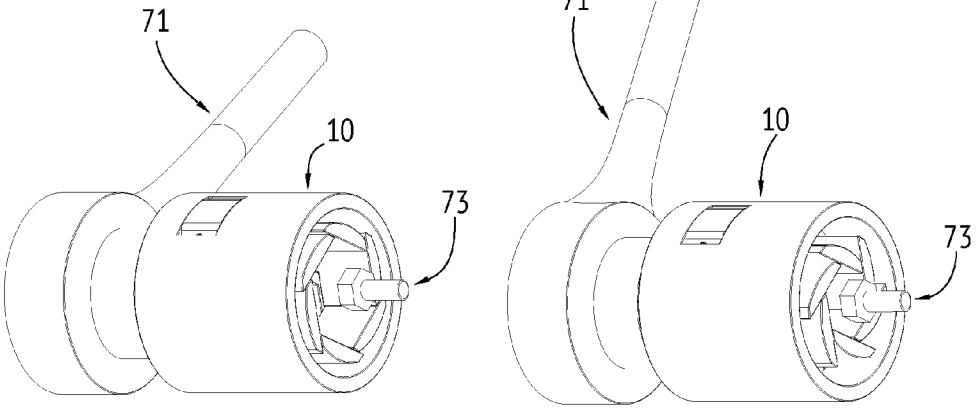
FIGS. 11C, 11D, and 11E are oblique side views depicting the FIG. 1 adjustable socket's jaws tightening on a schematically-shown fastener, as the ratcheting socket-driving tool is rotated in the direction indicated by the arrow in FIG. 11B.
Figure 11D:
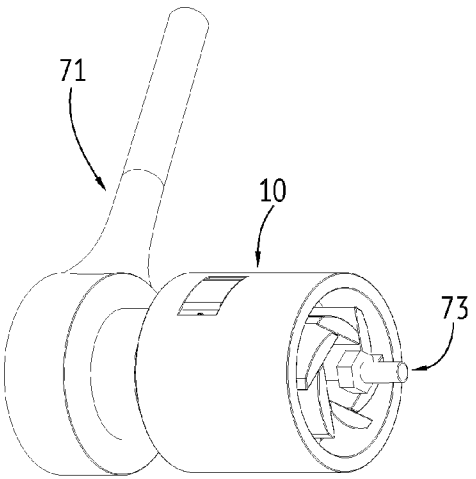
Figure 11E:
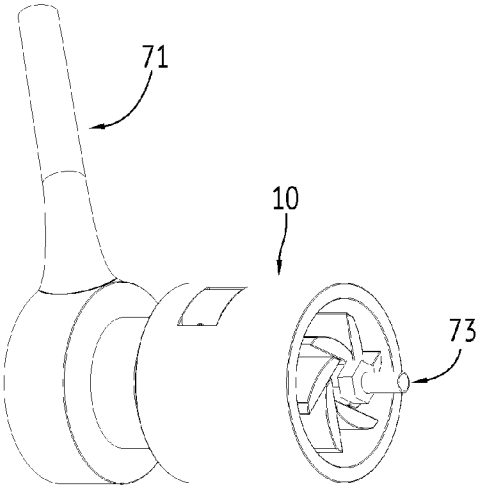

FIG. 11A illustrates adjustable socket 10 being affixed to a ratcheting socket-driving tool 71 with ½ inch drive element 72, via the direction indicated by arrow 82. FIGS. 11B-11E illustrate the ratcheting socket-driving tool 71 being rotated in direction 80, and the resultant action of adjustable socket 10 as it tightens down upon a 5/16 inch fastener 73.

Figure 12A:
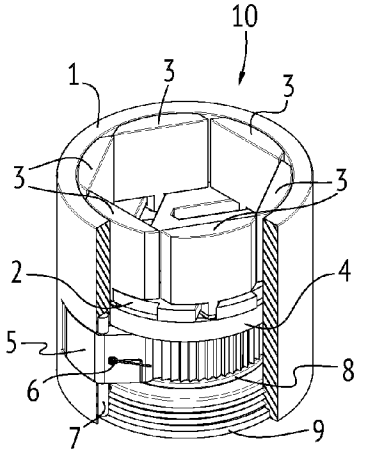
FIGS. 12A, 12B, 12C, and 12D are respectively oblique top front breakout, oblique bottom front breakout, top plan, and bottom plan views of the FIG. 1 adjustable socket, showing the jaws in a fully open position.
Figure 12B:
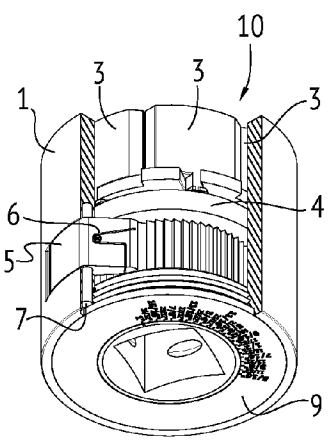
Figure 12C:
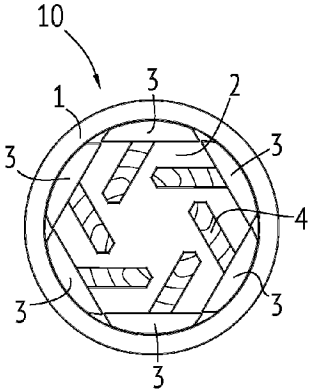
Figure 12D:
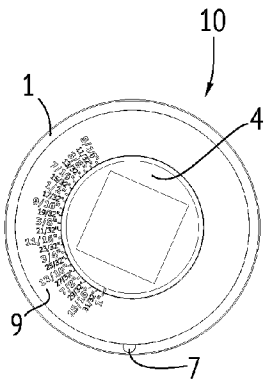

FIGS. 12A-12D show adjustable socket 10 with jaws 3 in a fully open position, spaced to accept a 1 inch fastener as indicated in FIG. 12D.

Figure 13A:
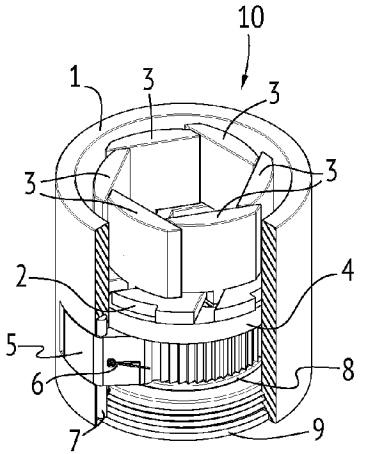
FIGS. 13A, 13B, 13C, and 13D are respectively oblique top front breakout, oblique bottom front breakout, top plan, and bottom plan views of the FIG. 1 adjustable socket, showing the jaws in a first partially closed position.
Figure 13B:
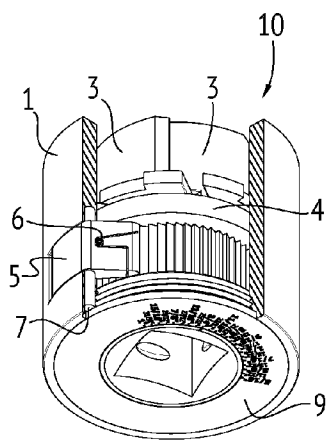
Figure 13C:
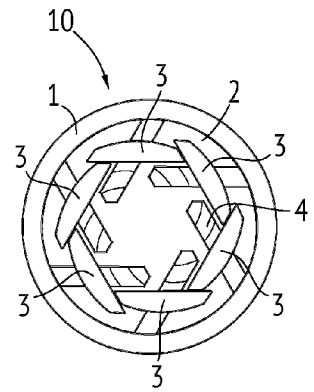
Figure 13D:
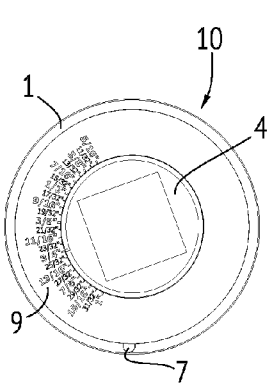

FIGS. 13A-13D show adjustable socket 10 after partial rotation of drive core 4 in direction 80, drawing jaws 3 inward into a first partially closed position, spaced to accept a ¾ inch fastener as indicated in FIG. 13D.

Figure 14A:
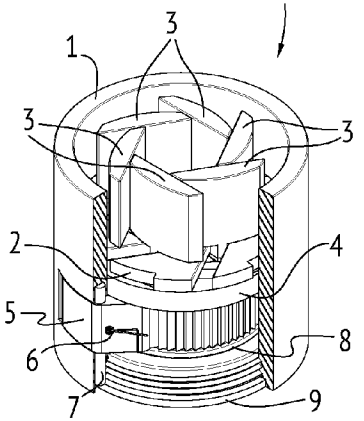
FIGS. 14A, 14B, 14C, and 14D are respectively oblique top front breakout, oblique bottom front breakout, top plan, and bottom plan views of the FIG. 1 adjustable socket, showing the jaws in a second partially closed position.
Figure 14B:
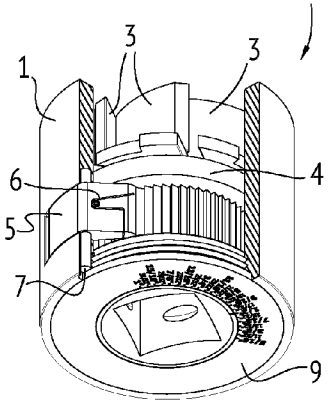
Figure 14C:
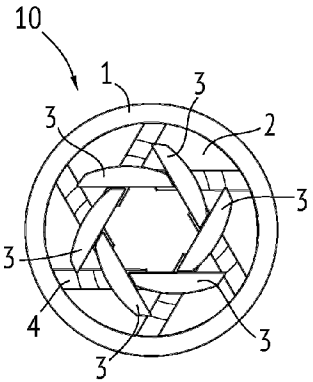
Figure 14D:
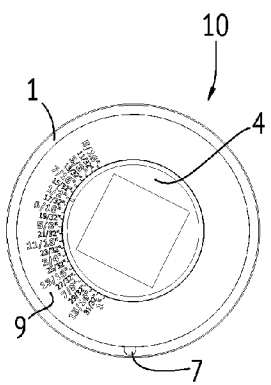

FIGS. 14A-14D show adjustable socket 10 after further rotation of drive core 4 in direction 80, drawing jaws 3 inward into a second partially closed position, spaced to accept a ½ inch fastener as indicated in FIG. 14D.

Figure 15A:
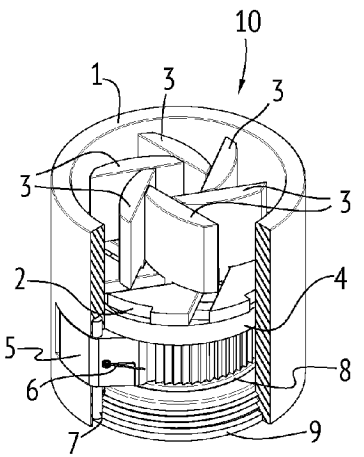
FIGS. 15A, 15B, 15C, and 15D are respectively oblique top front breakout, oblique bottom front breakout, top plan, and bottom plan views of the FIG. 1 adjustable socket, showing the jaws in a fully closed position.
Figure 15B:
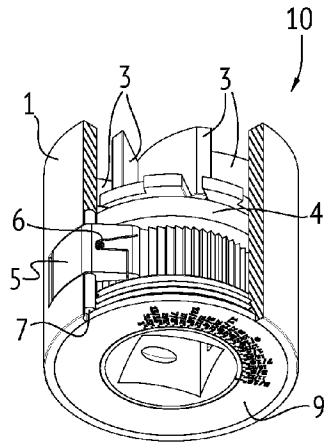
Figure 15C:
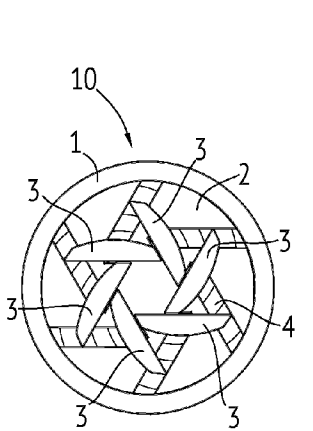
Figure 15D:
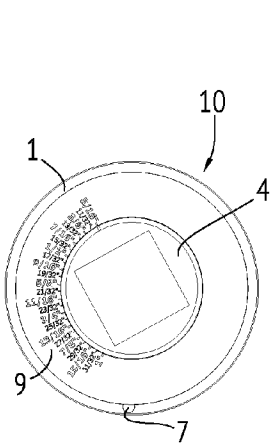

FIGS. 15A-15D show adjustable socket 10 after further rotation of drive core 4 in direction 80, drawing jaws 3 inward into a fully closed position, spaced to accept a 5/16 inch fastener as indicated in FIG. 15D.

Figure 16A:
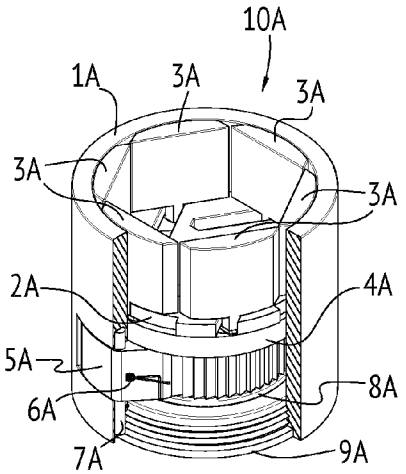
FIGS. 16A, 16B, 16C, and 16D are respectively oblique top front breakout, oblique bottom front breakout, top plan, and bottom plan views of an adjustable socket having sizing for metric fasteners and ¼ inch ratcheting socket-driving tools, showing the jaws in a fully open position.
Figure 16B:
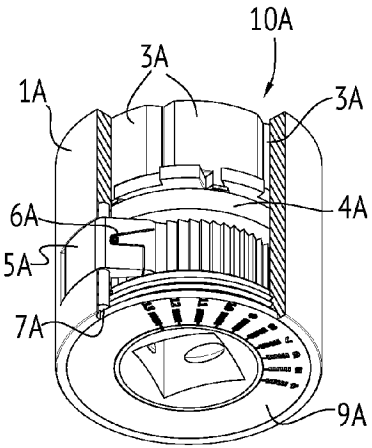
Figure 16C:
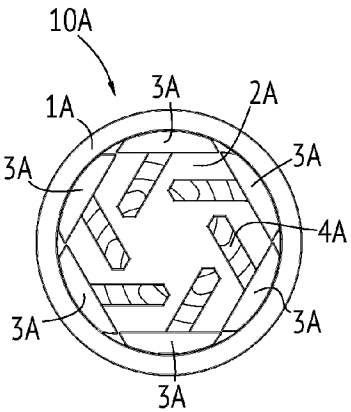
Figure 16D:
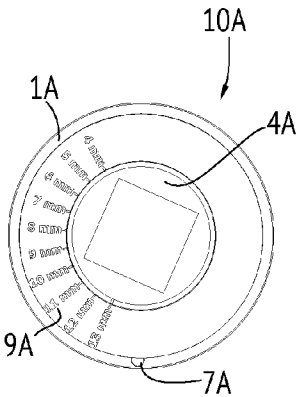

FIGS. 16A-16D show an alternative adjustable socket 10A, sized to fit metric fasteners and a ratcheting socket-driving tool with ¼ inch drive element. Jaws 3 are in a fully open position, spaced to accept a 13 millimeter fastener as indicated in FIG. 16D.

Figure 17A:
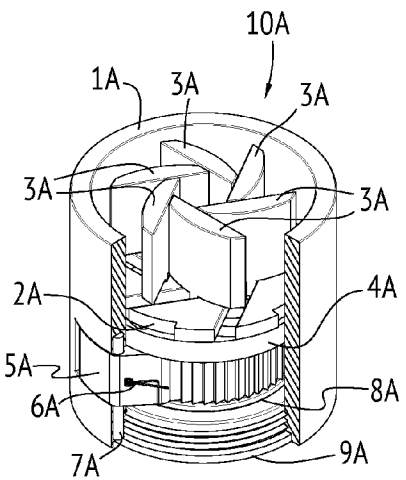
FIGS. 17A, 17B, 17C, and 17D are respectively oblique top front breakout, oblique bottom front breakout, top plan, and bottom plan views of an adjustable socket having sizing for metric fasteners and ¼ inch ratcheting socket-driving tools, showing the jaws in a fully closed position.
Figure 17B:
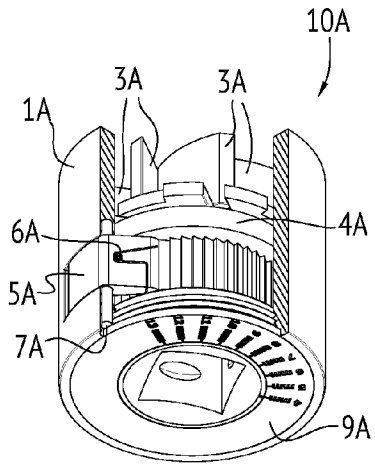
Figure 17C:
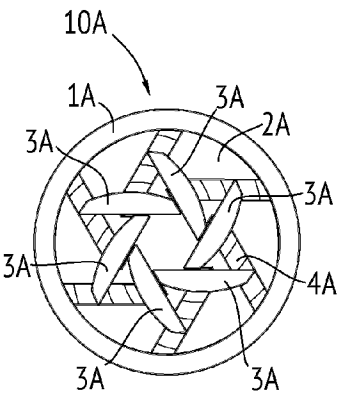
Figure 17D:
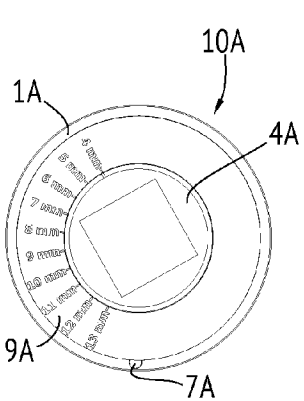

FIGS. 17A-17D show alternative adjustable socket 10A, sized to fit metric fasteners and a ratcheting socket-driving tool with ¼ inch drive element. Jaws 3 are in a fully closed position, spaced to accept a 4 millimeter fastener as indicated in FIG. 17D.

Figure 18A:
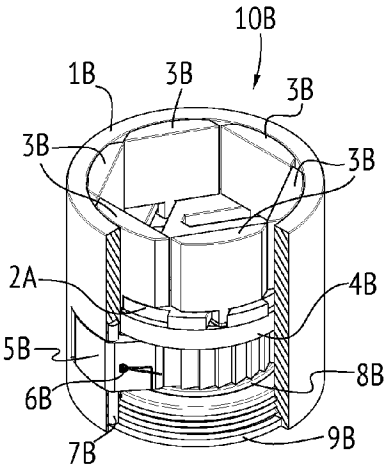
FIGS. 18A, 18B, 18C, and 18D are respectively oblique top front breakout, oblique bottom front breakout, top plan, and bottom plan views of an adjustable socket having sizing for standard fasteners and ¼ inch ratcheting socket-driving tools, showing the jaws in a fully open position.
Figure 18B:
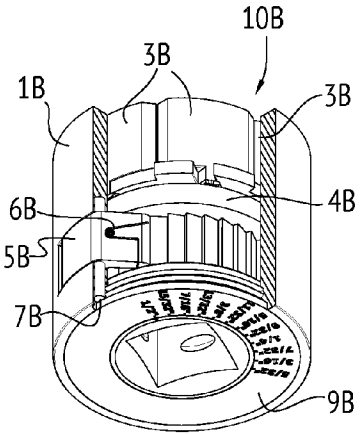
Figure 18C:
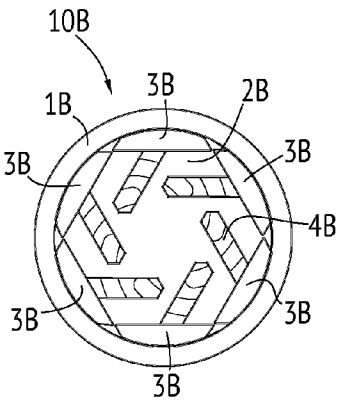
Figure 18D:
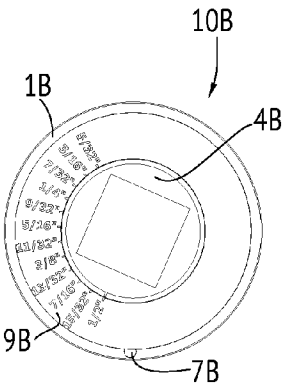

FIGS. 18A-18D show an alternative adjustable socket 10B, sized to fit standard fasteners and a ratcheting socket-driving tool with ¼ inch drive element. Jaws 3 are in a fully open position, spaced to accept a ½ inch fastener as indicated in FIG. 18D.

Figure 19A:
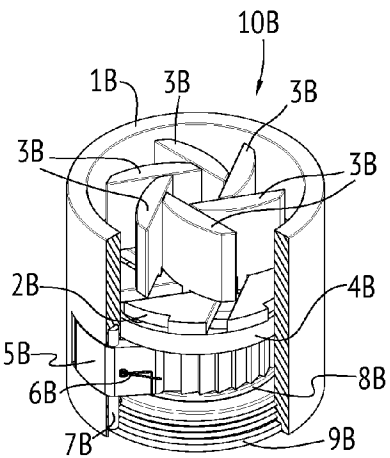
FIGS. 19A, 19B, 19C, and 19D are respectively oblique top front breakout, oblique bottom front breakout, top plan, and bottom plan views of an adjustable socket having sizing for standard fasteners and ¼ inch ratcheting socket-driving tools, showing the jaws in a fully closed position.
Figure 19B:
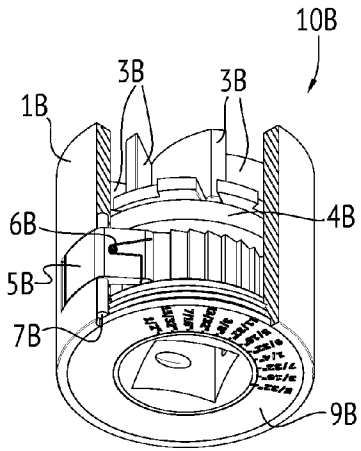
Figure 19C:
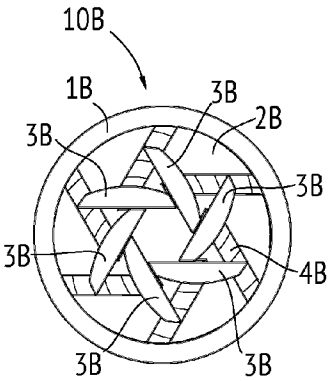
Figure 19D:
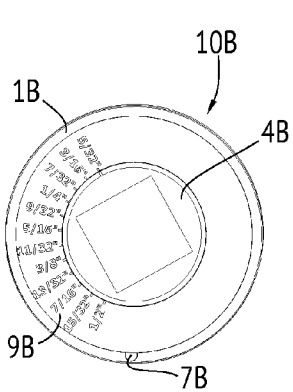

FIGS. 19A-19D show alternative adjustable socket 10B, sized to fit standard fasteners and a ratcheting socket-driving tool with ¼ inch drive element. Jaws 3 are in a fully closed position, spaced to accept a 5/32 inch fastener as indicated in FIG. 19D.

Figure 20A:
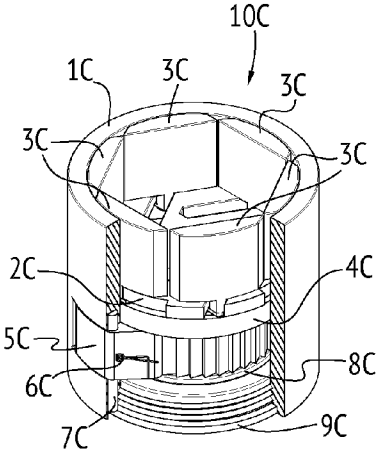
FIGS. 20A, 20B, 20C, and 20D are respectively oblique top front breakout, oblique bottom front breakout, top plan, and bottom plan views of an adjustable socket having sizing for metric fasteners and ⅜ inch ratcheting socket-driving tools, showing the jaws in a fully open position.
Figure 20B:
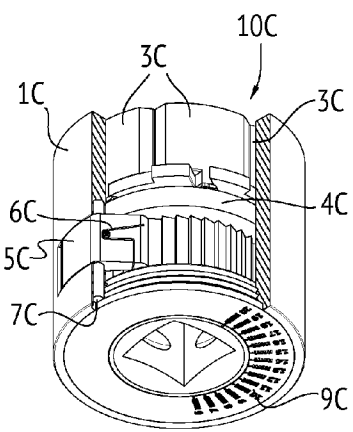
Figure 20C:
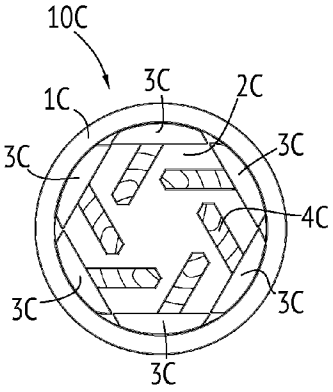
Figure 20D:
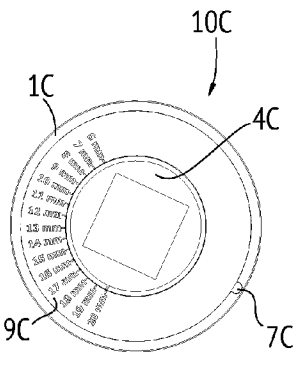

FIGS. 20A-20D show an alternative adjustable socket 10C, sized to fit metric fasteners and a ratcheting socket-driving tool with ⅜ inch drive element. Jaws 3 are in a fully open position, spaced to accept a 20 millimeter fastener as indicated in FIG. 20D.

Figure 21A:
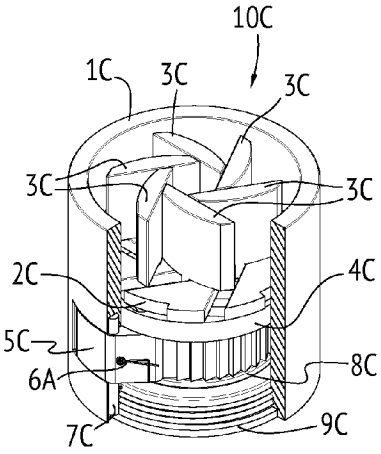
FIGS. 21A, 21B, 21C, and 21D are respectively oblique top front breakout, oblique bottom front breakout, top plan, and bottom plan views of an adjustable socket having sizing for metric fasteners and ⅜ inch ratcheting socket-driving tools, showing the jaws in a fully closed position.
Figure 21B:
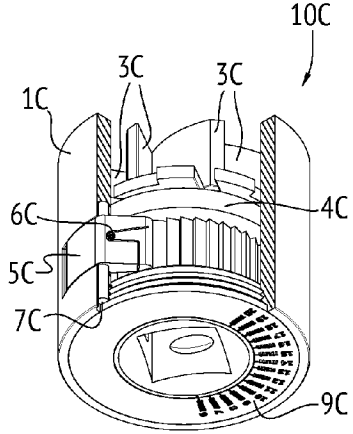
Figure 21C:
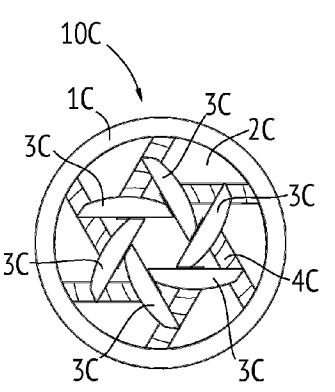
Figure 21D:
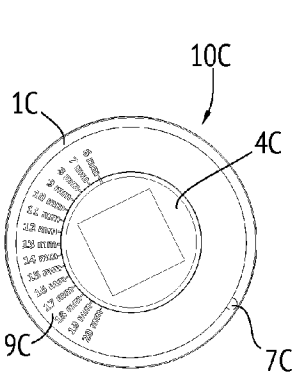

FIGS. 21A-21D show alternative adjustable socket 10C, sized to fit metric fasteners and a ratcheting socket-driving tool with ⅜ inch drive element. Jaws 3 are in a fully closed position, spaced to accept a 6 millimeter fastener as indicated in FIG. 21D.

Figure 22A:
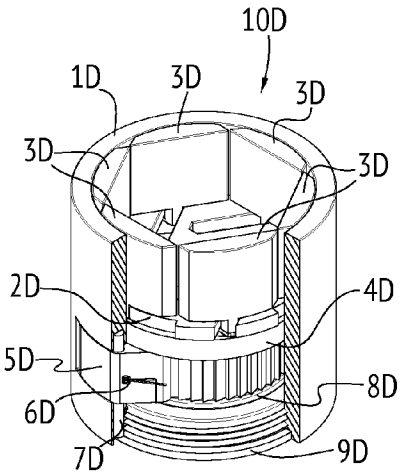
FIGS. 22A, 22B, 22C, and 22D are respectively oblique top front breakout, oblique bottom front breakout, top plan, and bottom plan views of an adjustable socket having sizing for standard fasteners and ⅜ inch ratcheting socket-driving tools, showing the jaws in a fully open position.
Figure 22B:
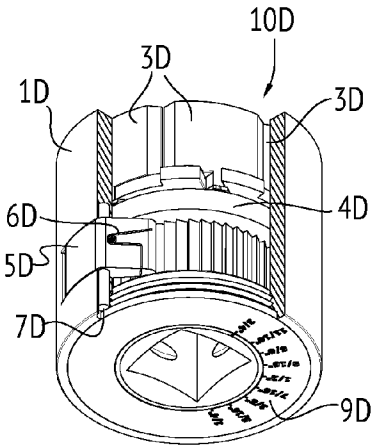
Figure 22C:
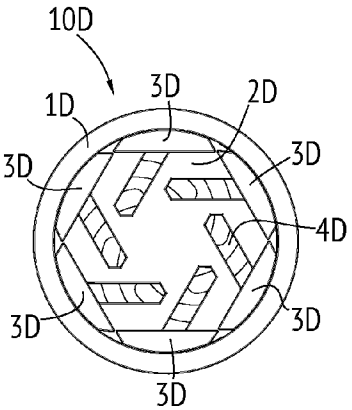
Figure 22D:
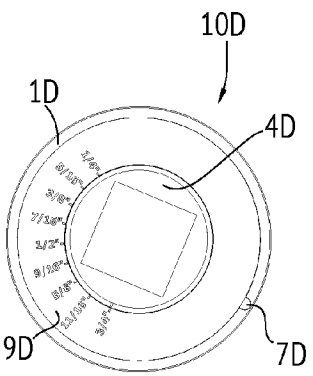

FIGS. 22A-22D show an alternative adjustable socket 10D, sized to fit standard fasteners and a ratcheting socket-driving tool with ⅜ inch drive element. Jaws 3 are in a fully open position, spaced to accept a ¾ inch fastener as indicated in FIG. 22D.

Figure 23A:
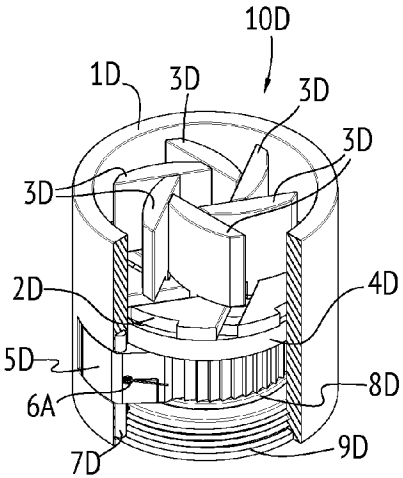
FIGS. 23A, 23B, 23C, and 23D are respectively oblique top front breakout, oblique bottom front breakout, top plan, and bottom plan views of an adjustable socket having sizing for standard fasteners and ⅜ inch ratcheting socket-driving tools, showing the jaws in a fully closed position.
Figure 23B:
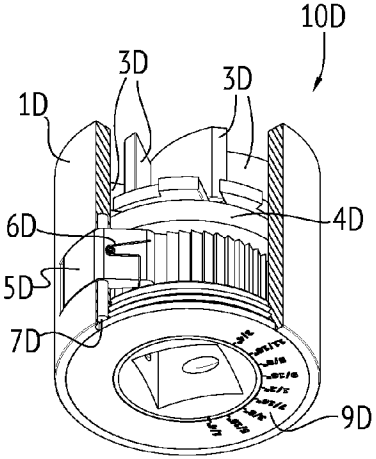
Figure 23C:
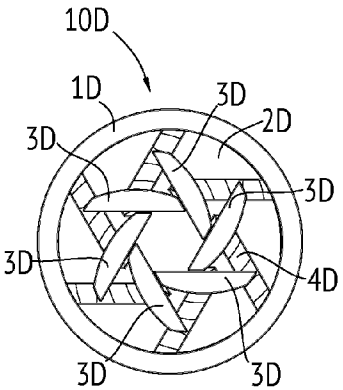
Figure 23D:
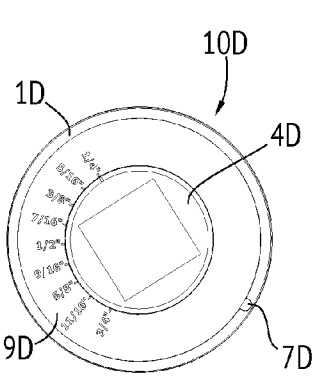

FIGS. 23A-23D show alternative adjustable socket 10D, sized to fit standard fasteners and a ratcheting socket-driving tool with ⅜ inch drive element. Jaws 3 are in a fully closed position, spaced to accept a ¼ inch fastener as indicated in FIG. 23D.

Figure 24A:
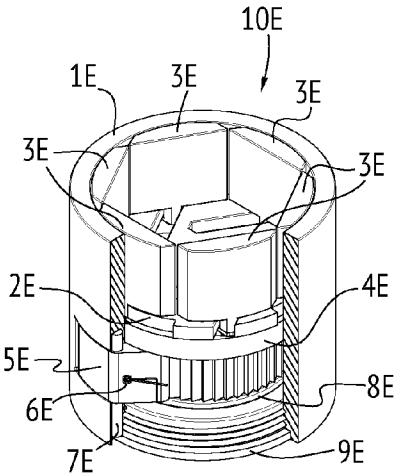
FIGS. 24A, 24B, 24C, and 24D are respectively oblique top front breakout, oblique bottom front breakout, top plan, and bottom plan views of an adjustable socket having sizing for metric fasteners and ½ inch ratcheting socket-driving tools, showing the jaws in a fully open position.
Figure 24B:
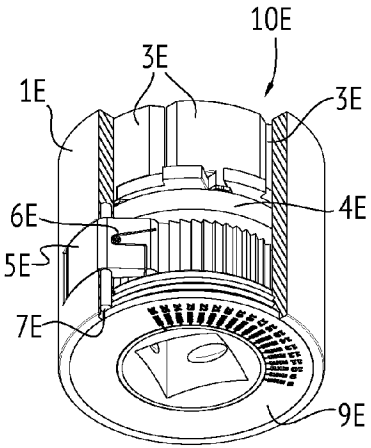
Figure 24C:
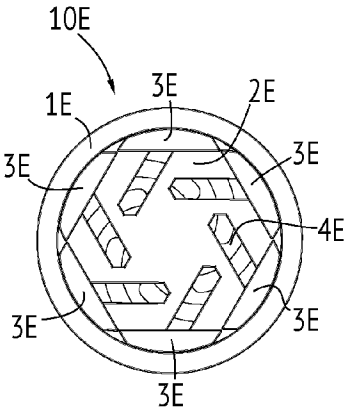
Figure 24D:
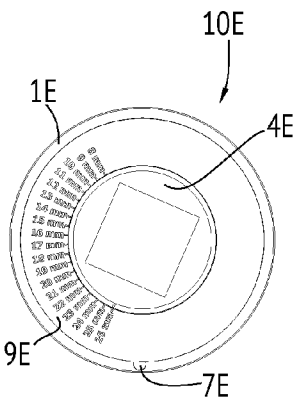

FIGS. 24A-24D show an alternative adjustable socket 10E, sized to fit metric fasteners and a ratcheting socket-driving tool with ½ inch drive element. Jaws 3 are in a fully open position, spaced to accept a 26 millimeter fastener as indicated in FIG. 24D.

Figure 25A:
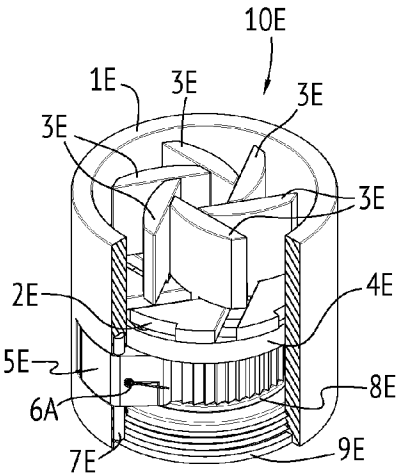
FIGS. 25A, 25B, 25C, and 25D are respectively oblique top front breakout, oblique bottom front breakout, top plan, and bottom plan views of an adjustable socket having sizing for metric fasteners and ½ inch ratcheting socket-driving tools, showing the jaws in a fully closed position.
Figure 25B:
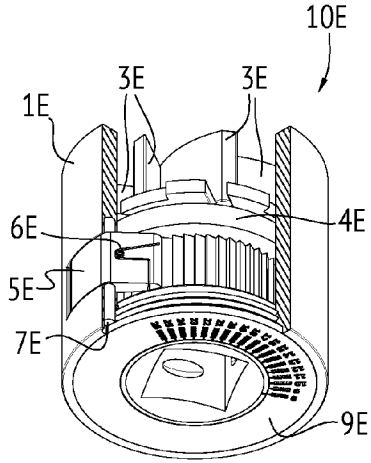
Figure 25C:
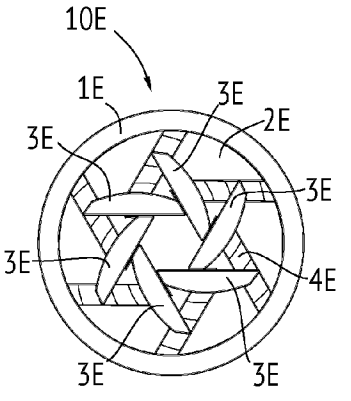
Figure 25D:
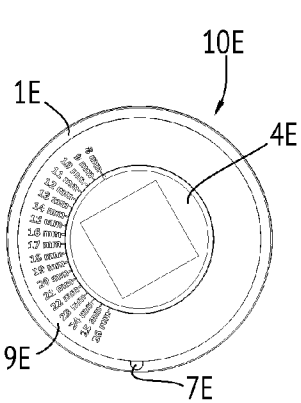

FIGS. 25A-25D show alternative socket 10E, sized to fit metric fasteners and a ratcheting socket-driving tool with ½ inch drive element. Jaws 3 are in a fully closed position, spaced to accept an 8 millimeter fastener as indicated in FIG. 25D.

Figure 26:
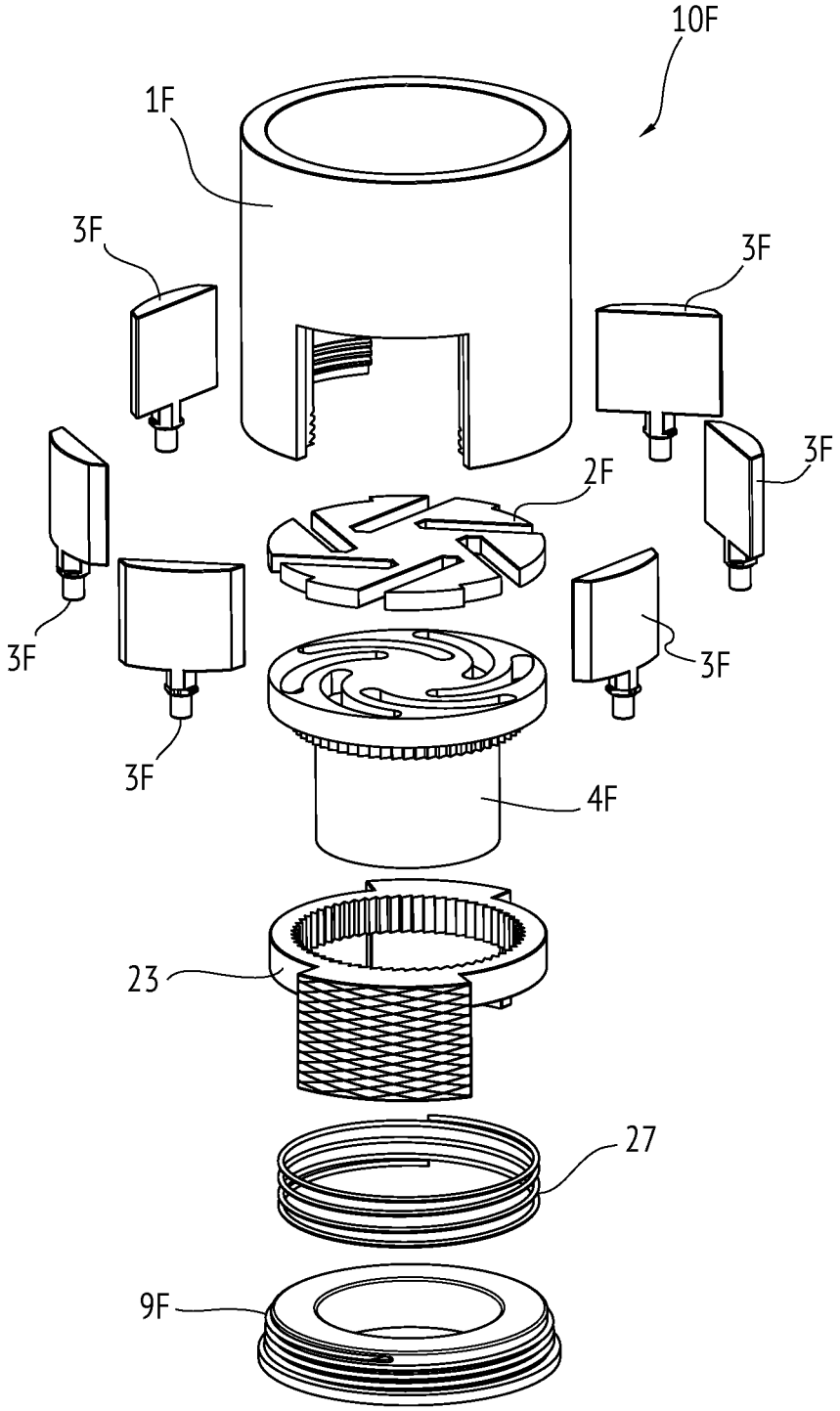
FIG. 26 is an exploded oblique top front view of an alternate embodiment of the adjustable socket, with a locking mechanism comprised of a biased indexing collar.
Figure 27:
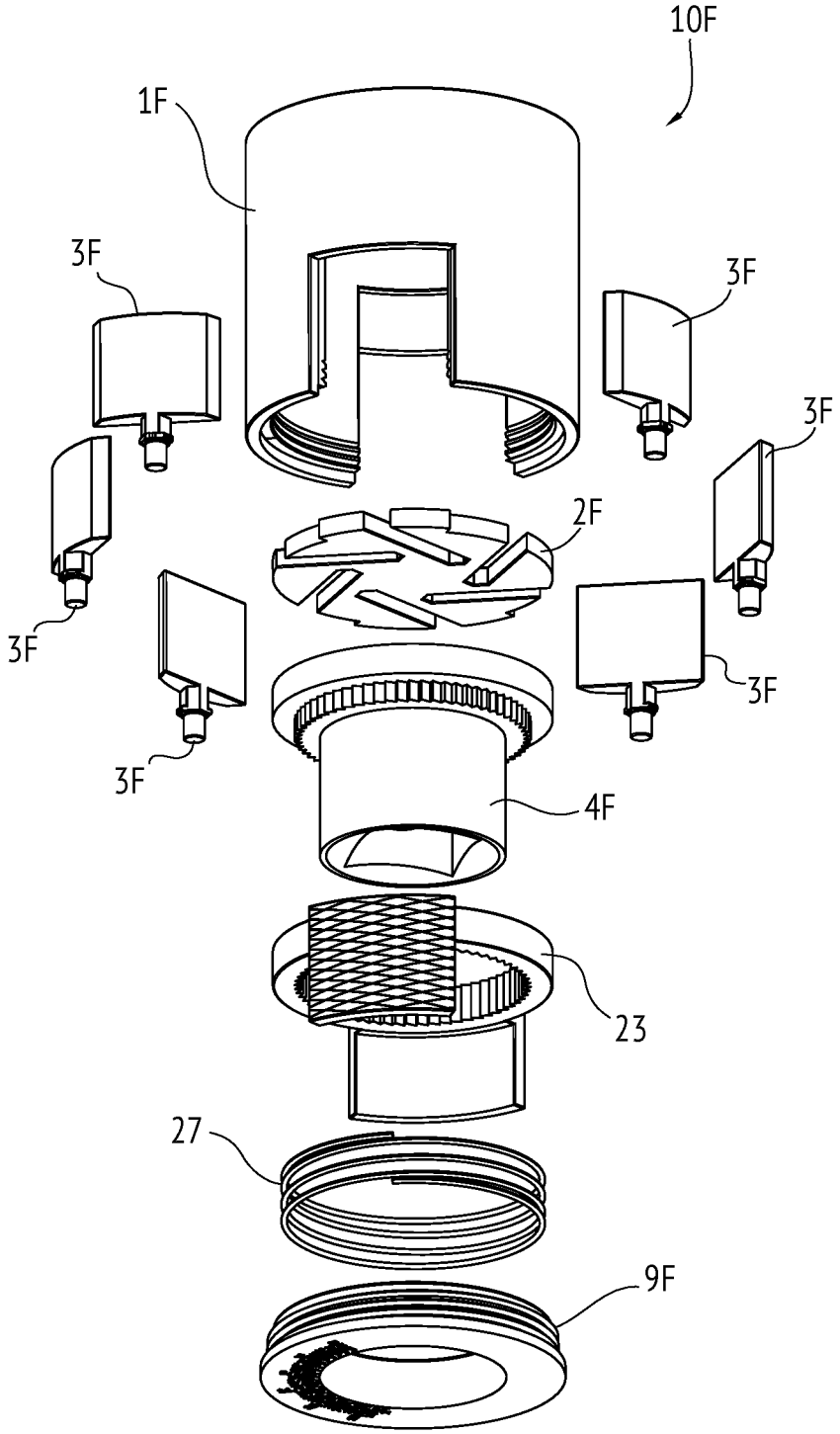
FIG. 27 is an exploded oblique bottom front view of an alternate embodiment of the adjustable socket, with a locking mechanism comprised of a biased indexing collar.
Figure 28B:
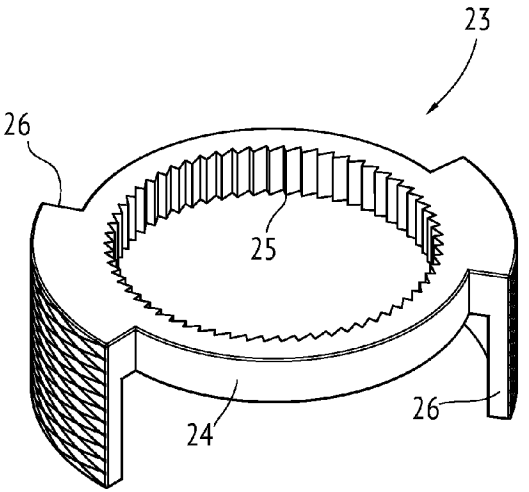
FIGS. 28A, 28B, 28C, and 28D are respectively top plan, oblique top front, front elevation, and oblique bottom front views of the FIG. 26 adjustable socket's indexing collar.
Figure 28D:
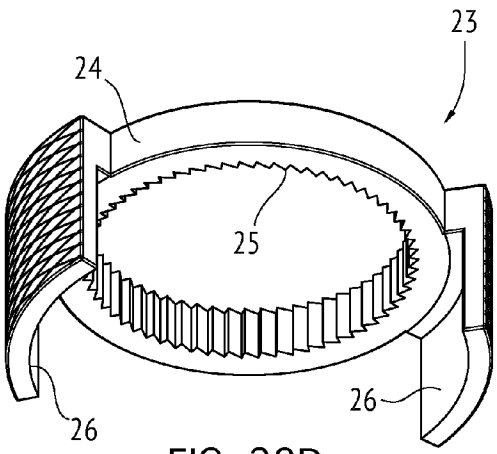
Figure 28A:
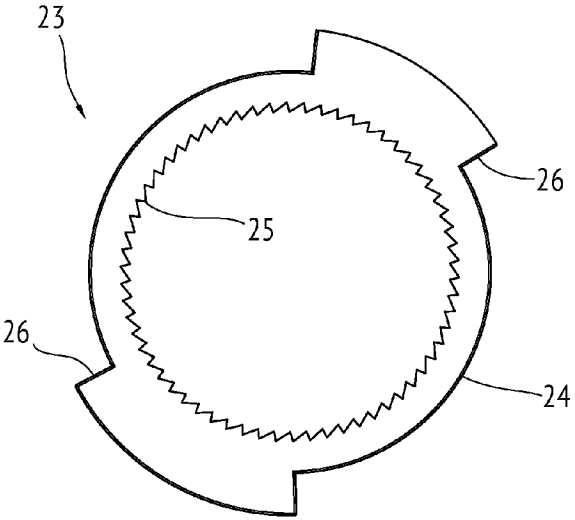
Figure 28C:
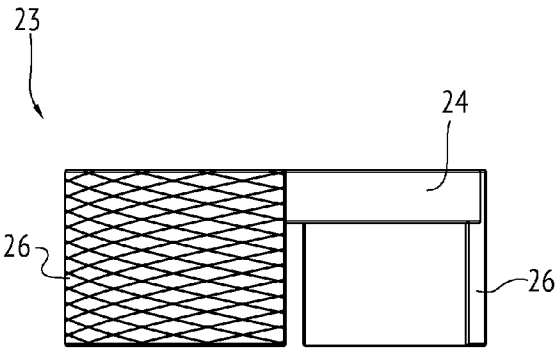

FIGS. 26-27 show an alternate embodiment 10F of the adjustable socket, comprising a locking mechanism in the form of a ring-shaped indexing collar 23, sized and shaped to fit into apertures in housing 1F and couple with teeth 42 of drive core 4F. A coil spring 27 is included within housing 1F and held in place by threaded plug 9F, to bias indexing collar 23 to a locked position yet allow manual release of drive core 4F for operation of the adjustable socket 1OF drive mechanism.

FIGS. 28A-28D depict the indexing collar 23 of adjustable socket 10F, comprising a collar ring 24 with a series of teeth 25 along the interior ring wall sized and shaped to couple with drive core 4F. Two asymmetrical tabs 26 are sized and shaped to allow insertion of indexing collar 23 into housing 1F, and to maintain fixed axial position of the indexing collar while the locking mechanism is operated.

Figure 29A:
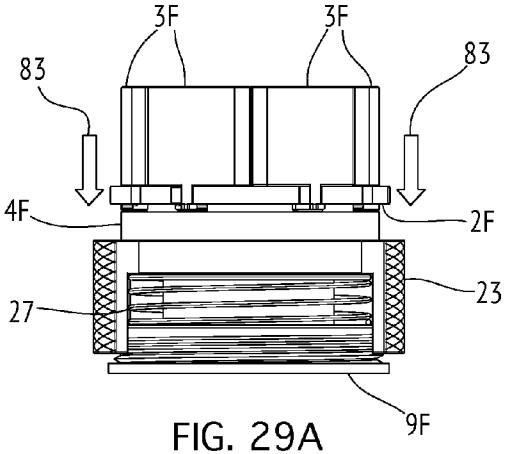
FIGS. 29A and 29B are front elevation views of the FIG. 26 adjustable socket's drive mechanism, with indexing collar in a locked and released position, respectively.
Figure 29B:
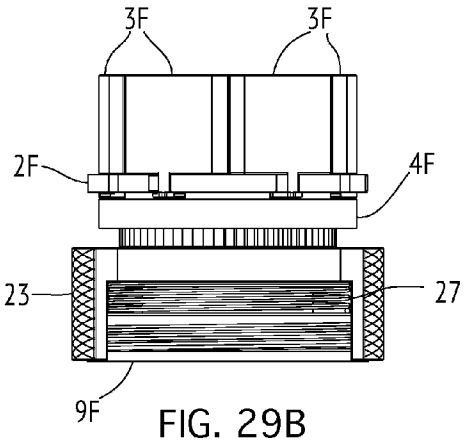

FIGS. 29A-29B depict the drive mechanism of adjustable socket 10F, with jaws 3F in a fully open position. It is understood that for the purposes of clearly illustrating the locking release action of the partial assembly depicted in FIGS. 29A-29B that housing 1F is not depicted, but that its presence would hold disc 2F and indexing collar 23 in the fixed axial positions shown. FIG. 29A demonstrates how coil spring 27, held in position by threaded plug 9F, biases indexing collar 23 into a position which couples with and locks drive core 4F in a fixed position. Manual movement of indexing collar 23 in the direction shown by arrows 83 releases drive core 4F, as shown in FIG. 29B, permitting operation of the adjustable socket 1OF drive mechanism.

Figure 29C:
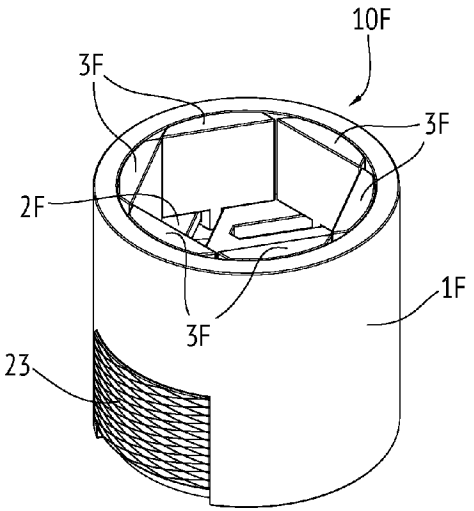
FIGS. 29C and 29D are oblique top front views of the FIG. 26 adjustable socket, with indexing collar in a locked and released position, respectively.
Figure 29D:
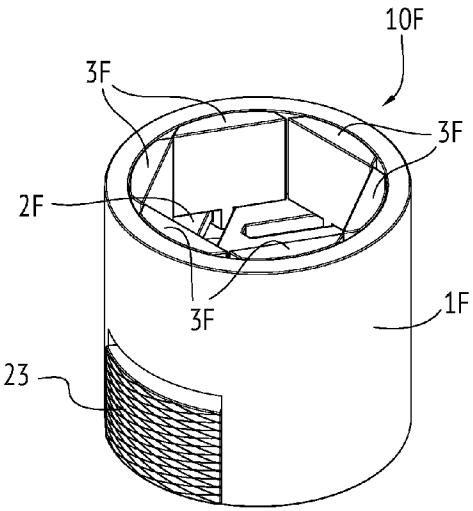

FIGS. 29C-29D depicts adjustable socket 10F, fully assembled with jaws 3F in a fully open position, with indexing collar 23 shown in locked and unlocked positions, respectively.

What is claimed is:

1. An adjustable socket having a plurality of selectable socket size openings, comprising:

a. a housing, generally cylindrical in shape and having a generally circular cross-section aligned along a longitudinal axis, comprising:
   i. a top housing lip; and
   ii. a bottom housing lip; and
   iii. an interior housing wall; and
   iv. a series of locking grooves extending longitudinally along the interior housing wall; and b. a disc, generally circular in cross-section and having a circular perimeter, the disc comprising:
   i. a plurality of guide slots:
      1. open to the perimeter; and
      2. angled obliquely off-center; and
   ii. a plurality of locking tabs extending out radially from the perimeter, sized and shaped to couple with the locking grooves of the housing; and c. a plurality of jaw members, sized and shaped to move laterally within the disc guide slots, and wherein rotation, vertical motion, and tilting of the jaws, relative to a center longitudinal axis of the housing, remains fixed, each jaw member comprising:
   i. a flat shaped inward face, facing toward the longitudinal axis of the housing; and
   ii. two flat side faces, located perpendicular to both the top face and the bottom face, the side faces angled to allow adjacent jaw members to slide past one another during operation of the mechanism; and
   iii. a stem extending at a perpendicular angle downward from the flat bottom face; and
   iv. a cam extending downward below the stem; and d. a drive core, generally circular in cross-section and axially rotatable within the housing, comprising:
   i. a top cam surface at a right angle to the longitudinal axis of the housing, with guide elements sized and shaped to accept the cams of each jaw member; and
   ii. wherein rotation of the drive core within the housing forces the jaw members to travel inwardly or outwardly along the disc guide slots as dictated by the cam surface; and
   iii. a series of teeth extending downward from the cam surface; and
   iv. a drive shaft extending downward from the teeth; and e. a locking mechanism that locks the drive core and jaws into different positions corresponding to various socket size openings; and f. a plug, sized and shaped to couple with the housing bottom, containing the drive mechanism within the housing, and allowing for the drive shaft to accept a drive element.

2. The adjustable socket of claim 1, wherein the housing is generally circular in cross-section and aligned along a longitudinal axis, and the series of locking grooves extend longitudinally along the interior housing wall and terminate below the top housing lip, further comprising:

a. female threads extending up from the bottom housing lip, sized and shaped to couple with a threaded plug; and b. an aperture in the exterior housing wall, adapted to accept a locking lever and torsion spring; and c. a pin hole extending from the bottom housing lip through the aperture, adapted to accept and hold a locking pin.

3. The adjustable socket of claim 1, wherein the disc further comprises:
   a. six guide slots:
      i. open to the perimeter; and
      ii. angled obliquely off-center at approximately a 60 degree differential from an adjacent guide slot; and
      iii. terminating with a tapered face; and
   b. a plurality of locking tabs extending out radially from the perimeter, sized and shaped to couple with the locking grooves of the housing.

4. The adjustable socket of claim 1, wherein each jaw member further comprises:
   a. a flat shaped top face; and
   b. a flat shaped bottom face; and
   c. a convex shaped outward face, facing away from the center longitudinal axis of the housing; and
   d. a grooved stem with two beveled faces, extending downward from the flat bottom face; and
   e. two locking tabs extending laterally from the base of the grooved stem; and
   f. a chamfered bumper along an interface between the cam and grooved stem.

5. The adjustable socket of claim 1, wherein the drive core further comprises:
   a. the top cam surface at a right angle to the longitudinal axis of the housing, with six spiraling slotted guide elements sized and shaped to accept the cams of each jaw member; and
   b. wherein rotation of the drive core within the housing forces the jaw members to travel inwardly along the disc guide slots as dictated by the cam surface, and the inward faces of the jaw members are forced against corresponding faces of a fastener located within the jaw members; and
   c. a series of teeth extending downward from the cam surface, sized and shaped to be engaged by a locking mechanism; and
   d. a generally cylindrical drive shaft extending downward from the teeth; and
   e. a drive aperture within the bottom of the drive shaft, adapted to accept a ratcheting socket-driving tool; and
   f. a sizing notch adapted to indicate the size of fastener the current jaw positions are sized to accept.

6. The adjustable socket of claim 1 further comprising a locking mechanism mounted into an aperture within the housing that locks the drive core and jaws into different positions corresponding to various socket size openings, and releases the drive core via manual depression, allowing the drive core to rotate in the opposite direction to release the fastener, the locking mechanism comprising:
   a. a locking lever comprising:
      i. a pin hole sized and shaped to accept a locking pin; and
      ii. an interior tooth, sized and shaped to couple with the teeth of the drive core; and
      iii. an exterior face sized and shaped to meet flush with the exterior housing wall, and
      iv. a spring hole and spring groove located at the interface between the interior face and tooth, sized and shaped to accept and hold the locking arm of a torsion spring; and
   b. a torsion spring that provides a biasing force to move the locking lever into a locking position, the torsion spring comprising:
      i. a locking arm inserted into the spring hole of the lever; and
      ii. a torsion element that biases the spring in an open position; and
      iii. a biasing arm, sized and shaped to meet flush against the housing interior wall and bias the tooth into the female elements of the teeth of the drive core; and
   c. a pin, sized to lock the lever and biasing torsion spring in place within the housing aperture and allow for swiveling motion of the assembly.

7. The adjustable socket of claim 1, further comprising:
   a. a washer inserted between the drive core and plug, to allow manual rotation of the drive core by providing slip movement between the fixed position of the plug and moveable drive core, which is provided freedom of rotation around the center longitudinal axis of the housing.

8. The adjustable socket of claim 1, further comprising a plug, the plug being generally circular in cross-section and coupled to the housing, the plug comprising:
   a. a series of male threads extending between a top face and an outer lip, the series of male threads sized and shaped to couple with the female threads of the housing; and
   b. an outer lip, sized to enter into the housing so that a bottom face couples flush with a bottom housing lip and a lower drive core lip; and
   c. a series of sizing indicators etched into the bottom face and skirting the edge of the interior face, designed to indicate, via the drive core's sizing notch, the size of fastener the current jaw positions are sized to accept.

9. The adjustable socket of claim 1, further comprising a plug, the plug being generally circular in cross-section and coupled to the housing, the plug comprising:
   a. a series of male locking tabs extending between a top face and an outer lip, the series of male locking tabs sized and shaped to couple with the female threads of the housing; and
   b. an outer lip, sized to enter into the housing so that a bottom face couples flush with bottom housing lip and bottom drive core lip; and
   c. a series of sizing indicators etched into the bottom face and skirting the edge of the interior face, designed to indicate via the drive core's sizing notch the size of fastener the current jaw positions are sized to accept.

10. The adjustable socket of claim 1 wherein the housing is generally circular in cross-section and aligned along a longitudinal axis, further comprising:
   a. apertures extending longitudinally in the exterior housing wall, sized and shaped to accept an indexing collar; and
   b. a series of locking grooves extending beyond the apertures in the interior housing wall, sized and shaped to accept a disc; and
   c. female threads extending up from the bottom housing lip, sized and shaped to couple with a plug.

11. The adjustable socket of claim 10 wherein the locking mechanism comprises a ring-shaped indexing collar inserted into apertures in the housing with a series of teeth along the interior ring wall sized and shaped to couple with the drive core teeth, biased to a locked position by a coil spring and manually releasable to permit operation of the drive mechanism.

12. The adjustable socket of claim 1, wherein the jaw stem and disc guide slots comprise tongue-and-groove coupling elements.

13. The adjustable socket of claim 1 wherein biasing elements are used to bias the jaws away from the longitudinal axis of the housing.

14. The adjustable socket of claim 1 comprising three guide elements in the cam surface of the drive core, three disc guide slots offset by approximately 120 degrees from one another, and three jaws.

15. The adjustable socket of claim 1 comprising four guide elements in the cam surface of the drive core, four disc guide slots offset by approximately 90 degrees from one another, and four jaws.

16. The adjustable socket of claim 1 comprising five guide elements in the cam surface of the drive core, five disc guide slots offset by approximately 72 degrees from one another, and five jaws.

17. The adjustable socket of claim 1 further comprising a drive aperture in the housing for removably receiving a drive element for retaining position of the housing while operating the drive mechanism in deep socket situations.

18. The adjustable socket of claim 1 further comprising a drive element fixed to the housing for retaining position of the housing while operating the drive mechanism in deep socket applications.

19. The adjustable socket of claim 1 further comprising a drive extension element fixed to the drive core for operation of the drive mechanism in deep socket applications.

20. The adjustable socket of claim 1 further comprising a drive element fixed to the indexing collar of claim 11 for retaining position of the indexing collar while operating the drive mechanism in deep socket applications.

* * * * *